US008842045B2

(12) United States Patent
Tatarnikov et al.

(10) Patent No.: US 8,842,045 B2
(45) Date of Patent: Sep. 23, 2014

(54) COMPACT MULTIPATH-RESISTANT ANTENNA SYSTEM WITH INTEGRATED NAVIGATION RECEIVER

(75) Inventors: Dmitry Tatarnikov, Moscow (RU); Pavel Shamatulsky, Moscow (RU); Andrey Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 958 days.

(21) Appl. No.: 12/944,793

(22) Filed: Nov. 12, 2010

(65) Prior Publication Data

US 2011/0115676 A1 May 19, 2011

Related U.S. Application Data

(60) Provisional application No. 61/261,797, filed on Nov. 17, 2009.

(51) Int. Cl.

| | |
|---|---|
| ***H01Q 1/38*** | (2006.01) |
| ***H01Q 1/48*** | (2006.01) |
| ***H01Q 21/30*** | (2006.01) |
| ***H01Q 5/00*** | (2006.01) |
| ***H01Q 9/04*** | (2006.01) |
| ***H01Q 21/28*** | (2006.01) |

(52) U.S. Cl.

CPC ..... *H01Q 9/0414* (2013.01); *H01Q 21/30* (2013.01); *H01Q 5/0072* (2013.01); *H01Q 1/48* (2013.01); *H01Q 9/0442* (2013.01); *H01Q 21/28* (2013.01)

USPC ..... 343/700 MS; 343/846

(58) Field of Classification Search

CPC ..... H01Q 21/065; H01Q 1/38; H01Q 9/0457

USPC ..... 343/700 MS, 846

See application file for complete search history.

(56) References Cited

U.S. PATENT DOCUMENTS 4,218,682 A * 8/1980 Frosch et al. ..... 343/700 MS
6,639,558 B2 * 10/2003 Kellerman et al. .... 343/700 MS (Continued)

FOREIGN PATENT DOCUMENTS

| | | |
|---|---|---|
| WO | WO2004027920 | 4/2004 |
| WO | WO 2006059937 | 6/2006 |
| WO | WO 2009133448 | 11/2009 |

OTHER PUBLICATIONS

PCT International Search Report corresponding to PCT Application PCT/IB2010/002901 filed Nov. 12, 2010 (4 pages).

Written Opinion of the International Searching Authority corresponding to PCT Application PCT/IB2010/002901 filed Nov. 12, 2010 (9 pages).

*Primary Examiner* — Michael C Wimer
*Assistant Examiner* — Hasan Islam
(74) *Attorney, Agent, or Firm* — Wolff & Samson, P.C.

(57) ABSTRACT

A patch antenna system with improved multipath resistance includes a top antenna assembly and a bottom antenna assembly. Each antenna assembly includes a radiator patch and a ground plane separated by a dielectric medium. The radiator patch on the top antenna assembly is excited by an exciter and an excitation circuit. The bottom antenna assembly is electromagnetically coupled to the top antenna assembly. The resonant frequency of the bottom antenna assembly is approximately equal to the resonant frequency of the top antenna assembly. Electromagnetic fields induced in the bottom antenna assembly are in opposite phase to the electromagnetic fields excited in the top antenna assembly. Amplitudes of electromagnetic fields induced in the bottom antenna assembly are subtracted from amplitudes of electromagnetic fields excited in the top antenna assembly, and multipath signals are suppressed. Single band and dual band antenna systems suitable for global navigation satellite systems can be implemented.

36 Claims, 29 Drawing Sheets

(56) References Cited

U.S. PATENT DOCUMENTS

| | | | | |
|---|---|---|---|---|
| 6,795,021 | B2 * | 9/2004 | Ngai et al. | 343/700 MS |
| 6,836,247 | B2 | 12/2004 | Soutiaguine et al. | |
| 7,372,408 | B2 * | 5/2008 | Gaucher et al. | 343/700 MS |
| 7,800,542 | B2 * | 9/2010 | Li et al. | 343/700 MS |
| 8,111,196 | B2 * | 2/2012 | Thiam et al. | 343/700 MS |
| 2003/0052825 | A1 * | 3/2003 | Rao et al. | 343/700 MS |
| 2004/0056803 | A1 | 3/2004 | Soutiaguine et al. | |
| 2009/0140930 | A1 | 6/2009 | Tatarnikov et al. | |
| 2009/0262024 | A1 | 10/2009 | Schillmeier et al. | |

* cited by examiner

VIEW C

VIEW C

VIEW D

VIEW D

VIEW E

VIEW E

VIEW D

VIEW B

VIEW C

VIEW A

VIEW E

VIEW D

VIEW C

VIEW E

VIEW E

VIEW E

VIEW E

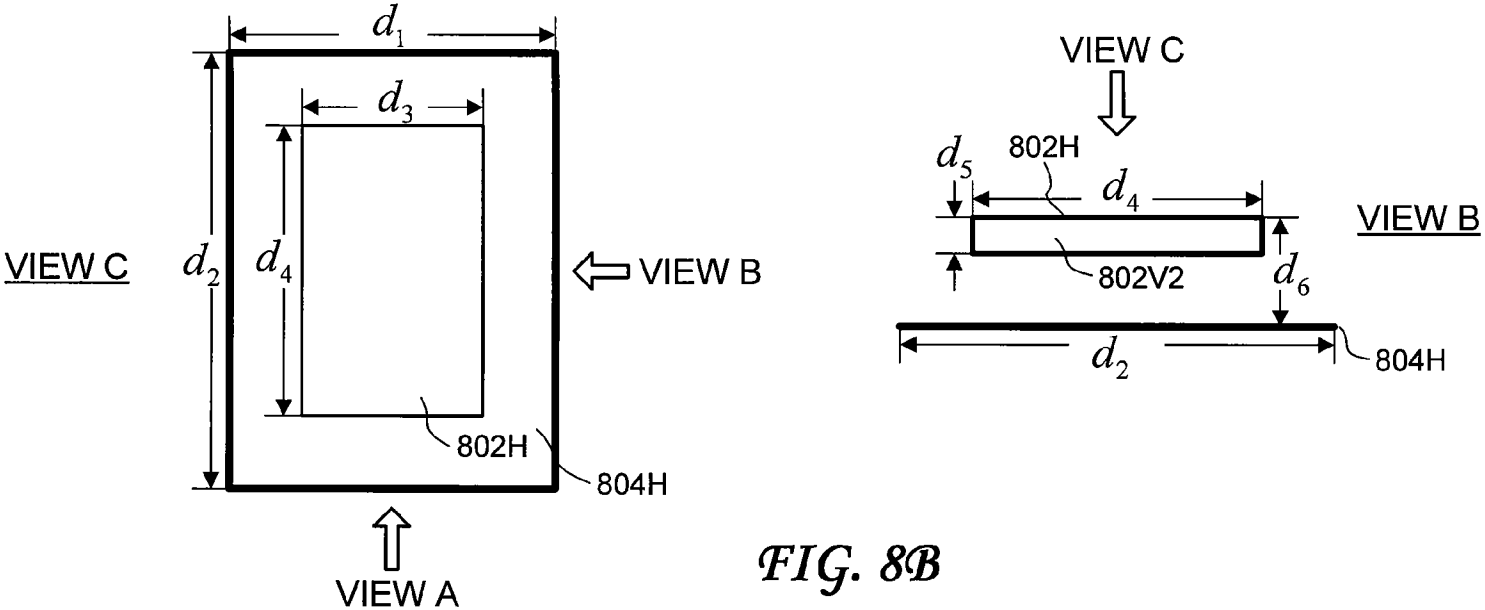
FIG. 8B
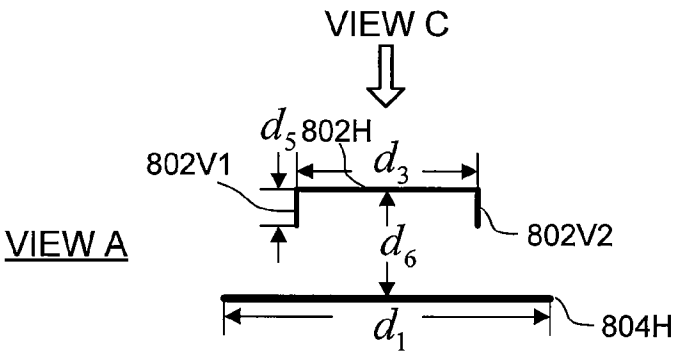

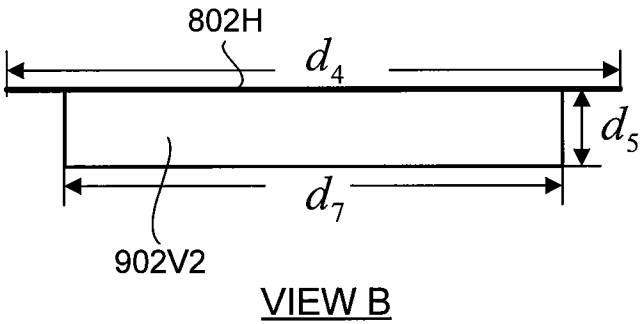
FIG. 9A
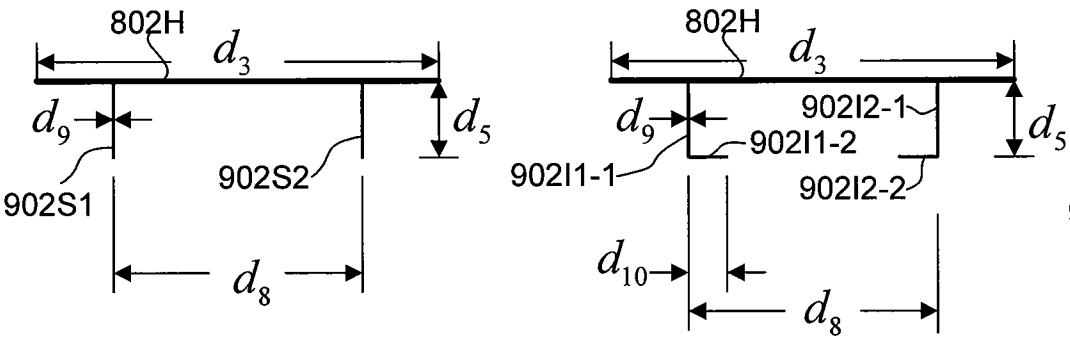
FIG. 9B
FIG. 9C
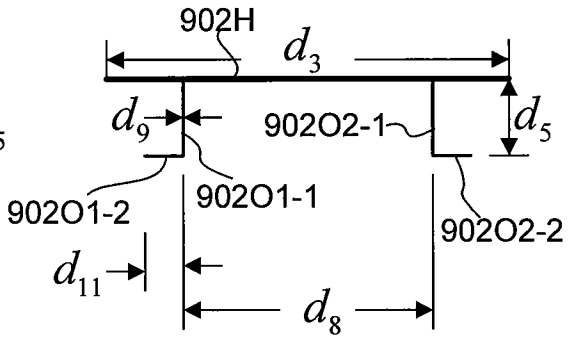
FIG. 9D

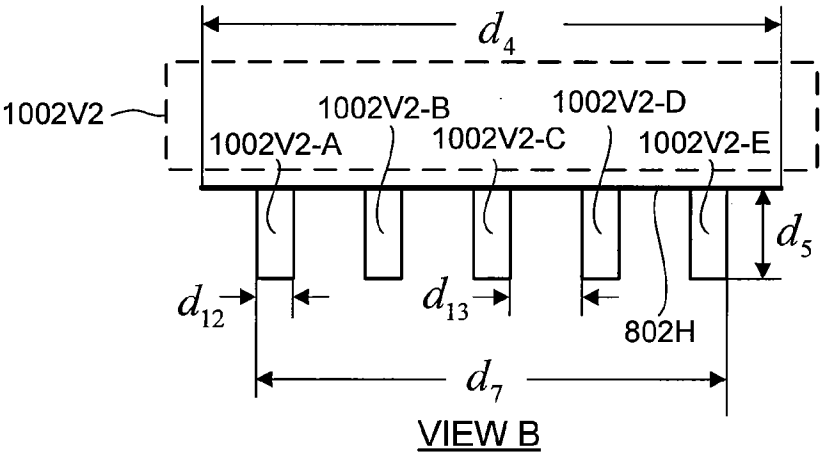
FIG. 10A
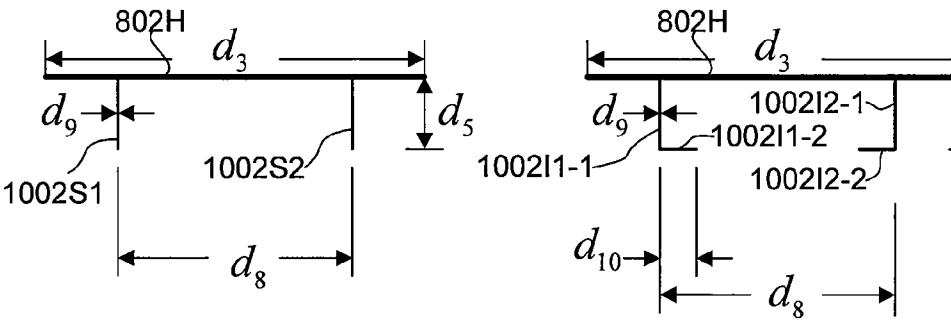
FIG. 10B
FIG. 10C
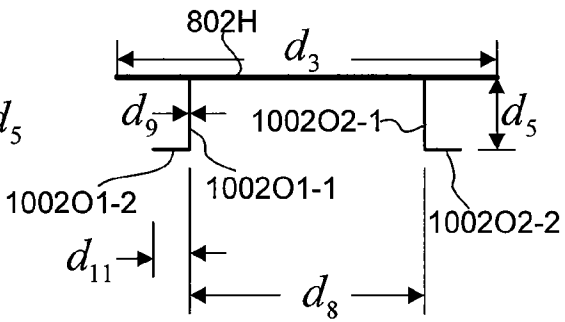
FIG. 10D

VIEW A

VIEW B

VIEW A

VIEW B

VIEW A

VIEW B

VIEW A

VIEW B

VIEW A

VIEW B

COMPACT MULTIPATH-RESISTANT ANTENNA SYSTEM WITH INTEGRATED NAVIGATION RECEIVER

This application claims the benefit of U.S. Provisional Application No. 61/261,797 filed Nov. 17, 2009, which is incorporated herein by reference.

BACKGROUND OF THE INVENTION

The present invention relates generally to antennas, and more particularly to micropatch antennas for global navigation satellite systems.

Micropatch antennas are well suited for navigation receivers in global navigation satellite systems (GNSSs). These antennas have the desirable features of compact size and wide bandwidth. Wide bandwidth is of particular importance for navigation receivers that receive and process signals from more than one GNSS. Currently deployed GNSSs are the US Global Positioning System (GPS) and the Russian GLONASS system. Other GNSSs such as the European GALILEO system are planned. Multi-system navigation receivers provide higher reliability due to system redundancy and better coverage due to a line-of sight to more satellites.

Multipath reception is a major source of positioning errors in GNSSs. Multipath reception refers to the reception by a navigation receiver of signal replicas caused by reflections from the complex environment in which navigation receivers are typically deployed. The signals received by the antenna in the navigation receiver are a combination of the line-of-sight signal and multipath signals reflected from the underlying ground surface and surrounding objects and obstacles. Reflected signals distort the amplitude and phase of the received signal. This signal degradation reduces system performance and reliability.

Performance of an antenna over a particular bandwidth is characterized by various parameters, such as the voltage standing-wave ratio (VSWR) and the directional pattern. A parameter that characterizes the multipath rejection capability of an antenna is the down/up ratio $$D/U(\theta) = \frac{F(-\theta)}{F(\theta)},$$

where $F(\theta)$ is the antenna directional pattern level at an angle $\theta$ in the forward hemisphere and $F(-\theta)$ is the antenna directional pattern level at the mirror angle $-\theta$ in the backward hemisphere. The zenith down/up ratio at $\theta=90°$, denoted D/U(90), is a commonly used parameter.

Multipath effects can be reduced by various antenna structures, such as a large, flat ground plane or a choke ring. These structures, however, increase the size and the weight of the antenna. To reduce dimensions and keep D/U(90) constant as a function of frequency, PCT International Publication Number WO 2004/027920 (published on Apr. 1, 2004) describes a GPS antenna with reduced multipath reception. The bandwidth is sufficient as a function of VSWR, but too narrow as a function of D/U(90).

Many existing antennas for precision GNSS applications were designed and manufactured for installation on geodetic poles or tripods at a particular height above the ground. For some GNSS applications, however, the antenna needs to be mounted on a vehicle. What is needed is a compact antenna that maintains a wide bandwidth and high multipath rejection for different mounting configurations.

BRIEF SUMMARY OF THE INVENTION

A patch antenna system with improved multipath resistance includes a top antenna assembly and a bottom antenna assembly. Each antenna assembly includes a radiator patch and a ground plane separated by a dielectric medium. The ground plane of the top antenna assembly and the ground plane of the bottom antenna assembly are electrically connected.

The radiator patch on the top antenna assembly is excited by an exciter and an excitation circuit. The bottom antenna assembly is electromagnetically coupled to the top antenna assembly. The resonant frequency of the top antenna assembly is tuned to the central operational frequency of the operational frequency band. The resonant frequency of the bottom antenna assembly is tuned to be approximately equal to the resonant frequency of the top antenna assembly.

The radiator patch on the top antenna assembly is electrically connected to a signal port. The radiator patch on the bottom antenna assembly is electromagnetically coupled to the signal port. Electromagnetic fields induced in the bottom antenna assembly by the top antenna assembly are in opposite phase to the electromagnetic fields excited in the top antenna assembly. Amplitudes of electromagnetic fields induced in the bottom antenna assembly are subtracted from amplitudes of electromagnetic fields excited in the top antenna assembly, and the strength of multipath signals is reduced.

In some embodiments, for each antenna assembly, the dielectric medium is air. To increase the bandwidth and directional pattern while maintaining a small resonant size, capacitive elements are disposed along the perimeter of the radiator patch, the perimeter of the ground plane, or along the perimeter of the radiator patch and the perimeter of the ground plane.

Various components can be integrated into the patch antenna system to create a compact antenna system suitable for mounting on a variety of surfaces, including the conductive surfaces of a vehicle. In some embodiments, a low-noise amplifier is integrated within the patch antenna system. In some embodiments, a navigation receiver is mounted below the second radiator patch. In some embodiments, one or more conductive closed cavities are mounted below the second radiator patch. Navigation receivers and auxiliary units, such as low-noise amplifiers, signal processors, attitude sensors, and tilt sensors, can be mounted within the closed cavities.

Embodiments of the patch antenna systems can be configured for single-band, dual-band, and multi-band operation.

These and other advantages of the invention will be apparent to those of ordinary skill in the art by reference to the following detailed description and the accompanying drawings.

BRIEF DESCRIPTION OF THE DRAWINGS

FIG. 8B shows design parameters for a single-band, linearly-polarized antenna system;

FIG. 9A-FIG. 9D show design parameters of capacitive elements configured as extended continuous structures;

FIG. 10A-FIG. 10D show design parameters of capacitive elements configured as series of localized structures;

FIG. 11B-FIG. 11L show orthogonal views of different embodiments of series of localized structures configured on radiator patches and ground planes for a single-band, circularly-polarized antenna system.

DETAILED DESCRIPTION

Figure 1A:
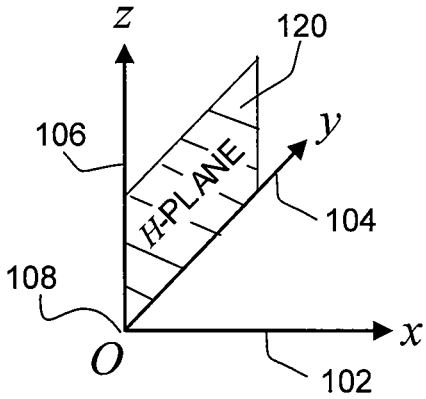
FIG. 1A-FIG. 1C show a reference Cartesian coordinate system for electric field planes and magnetic field planes.
Figure 1B:
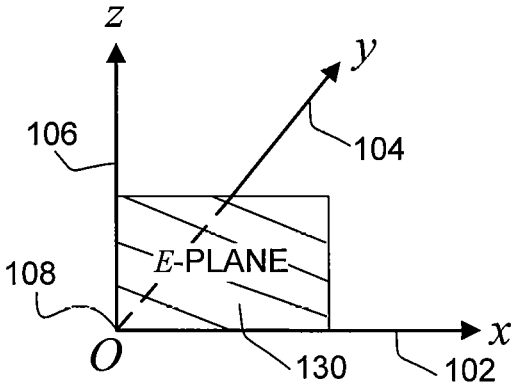

FIG. 1A and FIG. 1B show perspective views of a Cartesian coordinate system defined by the x-axis 102, y-axis 104, z-axis 106, and origin O 108. As shown in FIG. 1A, the magnetic field H-plane 120 lies in the y-z plane; as shown in FIG. 1B, the electric field E-plane 130 lies in the x-z plane.

Figure 1C:
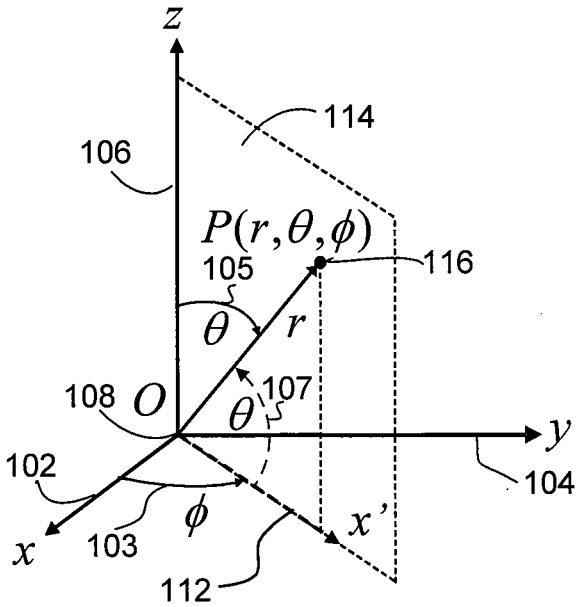

Geometric configurations are also described with respect to a spherical coordinate system, as shown in the perspective view of FIG. 1C. The spherical coordinates of a point P 116 are given by (r,θ,ϕ), where r is the radius measured from the origin O 108. Herein a point P has corresponding values of (r,θ,ϕ). The x-y plane is referred to as the azimuth plane; and ϕ 103, measured from the x-axis 102, is referred to as the azimuth angle. A plane defined by ϕ=constant and intersecting the z-axis 106 is referred to as a meridian plane. A general meridian plane 114, defined by the z-axis 106 and the x'-axis 112, is shown in FIG. 1C. The x-z plane and y-z plane are specific instances of meridian planes. In some conventions, the angle θ, referred to as the meridian angle, is measured from the z-axis 106 (denoted θ 105). In other conventions, as used herein, the angle θ is measured from the x'-axis 112 (denoted θ 107) and is also referred to as the elevation angle.

Figure 2:
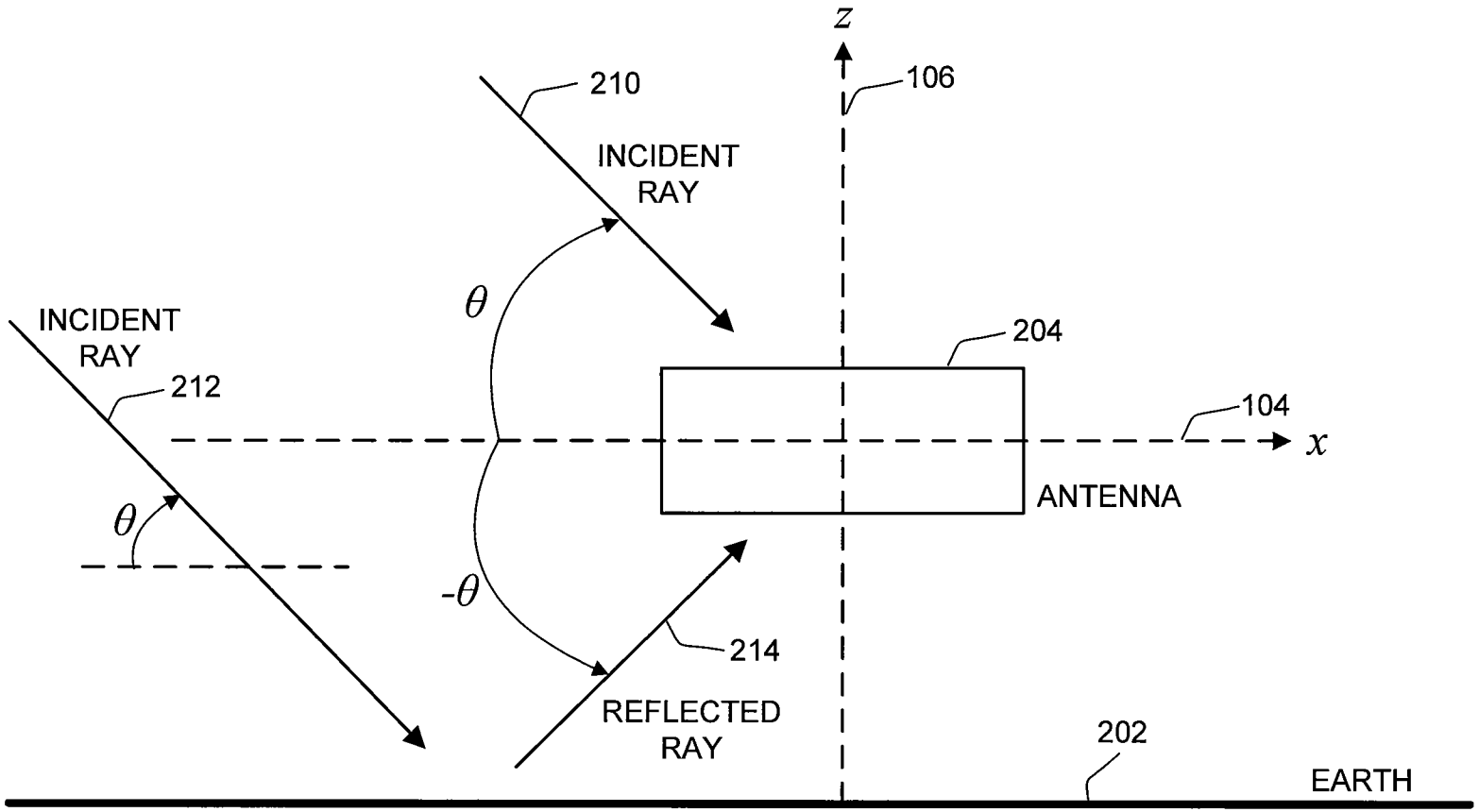
FIG. 2 shows a reference geometry for incident and reflected rays.

FIG. 2 shows a schematic of an antenna 204 positioned above the Earth 202. The antenna 204, for example, can be mounted on a surveyor's tripod (not shown) for geodetic applications. The plane of the figure is the E-plane (x-z plane). The +y direction points into the plane of the figure. In an open-air environment, the +z (up) direction (also referred to as the zenith) points towards the sky, and the −z (down) direction points towards the Earth. Herein, the term Earth includes both land and water environments. To avoid confusion with "electrical" ground, as used in reference to a ground plane, "geographical" ground, as used in reference to land, is not used herein.

In FIG. 2, electromagnetic waves are represented as rays, incident upon the antenna 204 at an incident angle θ with respect to the x-axis. The horizon corresponds to θ=0 deg. Rays incident from the open sky, such as ray 210 and ray 212, have positive values of incident angle. Rays reflected from the Earth 202, such as ray 214, have negative values of incident angle. Herein, the region of space with positive values of incident angle is referred to as the direct signal region. The direct signal region is also referred to as the forward hemisphere and as the top hemisphere. Herein, the region of space with negative values of incident angle is referred to as the multipath signal region. The multipath signal region is also referred to as the backward hemisphere and as the bottom hemisphere. Incident ray 210 impinges directly on antenna 204. Incident ray 212 impinges on Earth 202. Reflected ray 214 results from reflection of incident ray 212 off Earth 202.

To numerically characterize the capability of an antenna to mitigate the reflected signal, the following ratio is commonly used:

$$DU(\theta) = \frac{F(-\theta)}{F(\theta)}. \tag{E1}$$

The parameter DU(θ) (down/up ratio) is equal to the ratio of the antenna directional pattern level F(−θ) in the backward hemisphere to the antenna directional pattern level F(θ) in the forward hemisphere at the mirror angle, where F represents a voltage level. Expressed in dB, the ratio is:

$$DU(\theta)\ (dB) = 20 \log DU(\theta). \tag{E2}$$

Figure 1D:
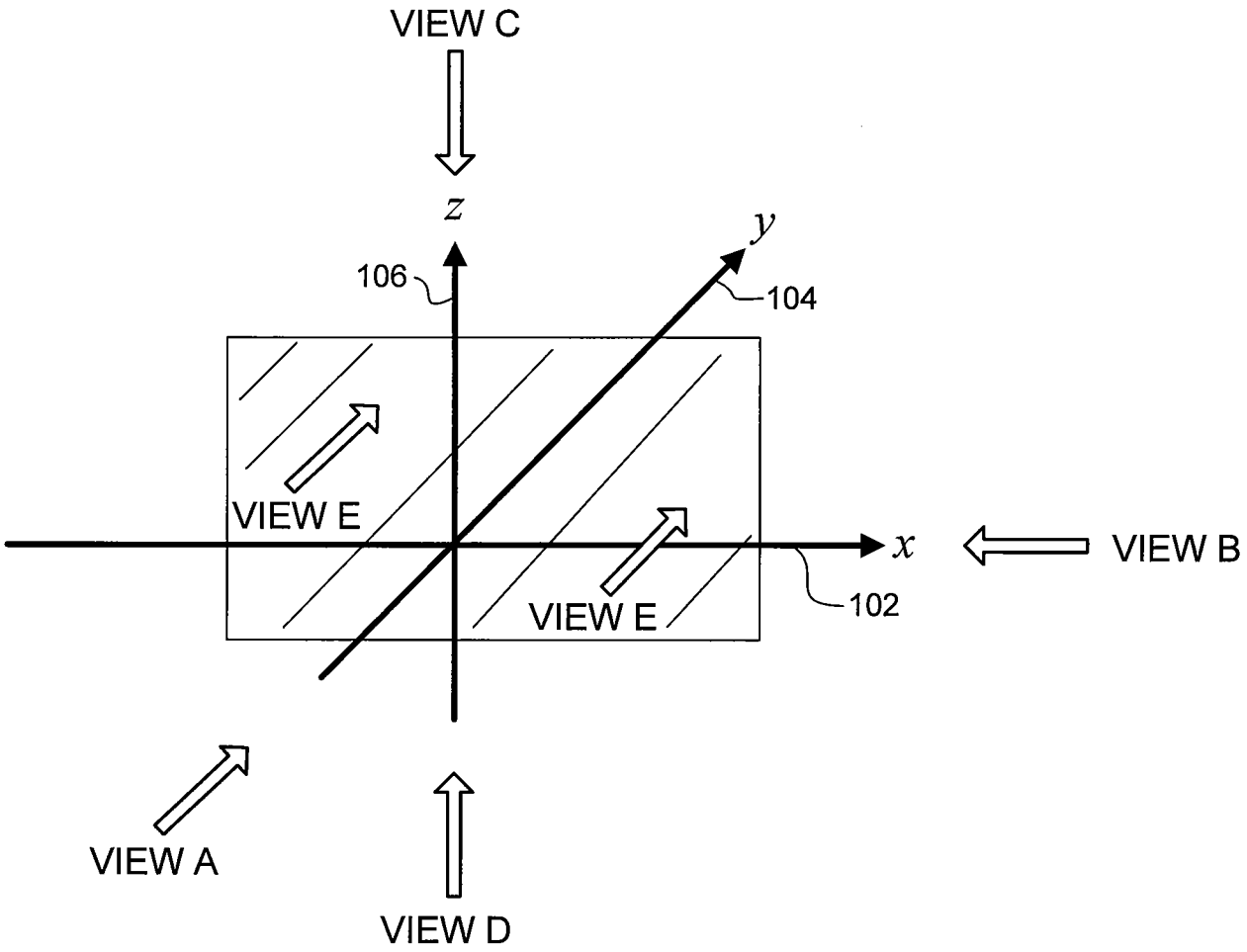
FIG. 1D shows orientations of reference views.

FIG. 1D defines the views for embodiments of antenna systems shown below. View A is sighted along the +y direction; View B is sighted along the −x direction; View C is sighted along the −z direction; and View D is sighted along the +Z direction. View E is a cross-sectional view in which the cross-sectional plane of the figure is parallel to the x-z plane.

Figure 1E:
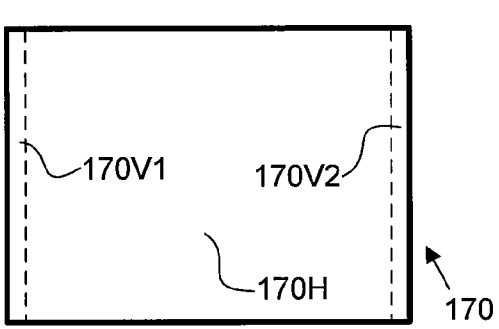
FIG. 1E-FIG. 1J show reference views of geometrical structures.
Figure 1H:
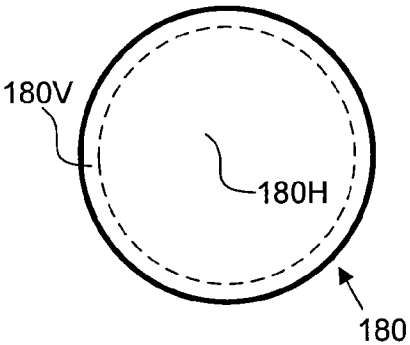
Figure 1F:
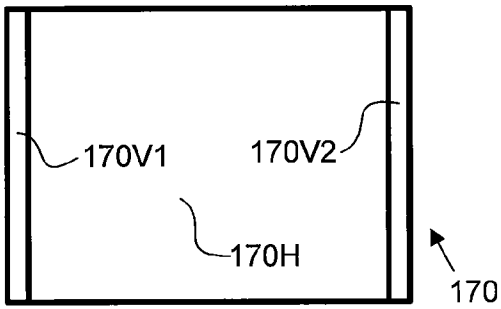
Figure 1I:
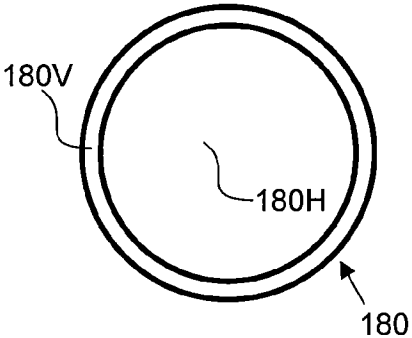
Figure 1G:
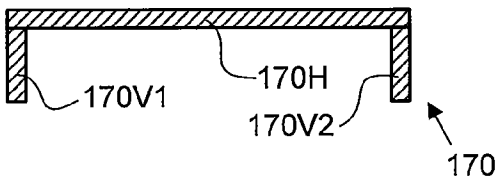
Figure 1J:
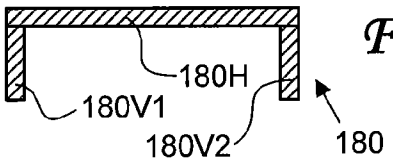
Figure 1L:
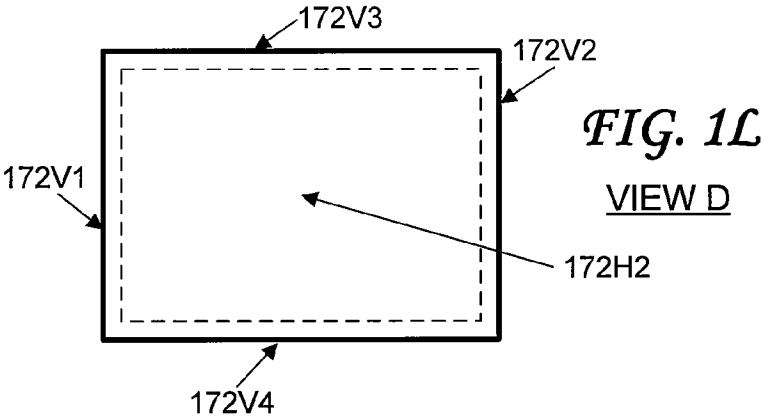
FIG. 1K-FIG. 1S show reference views of closed cavities.
Figure 1N:
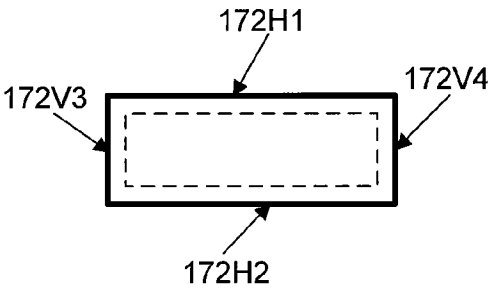
Figure 1K:
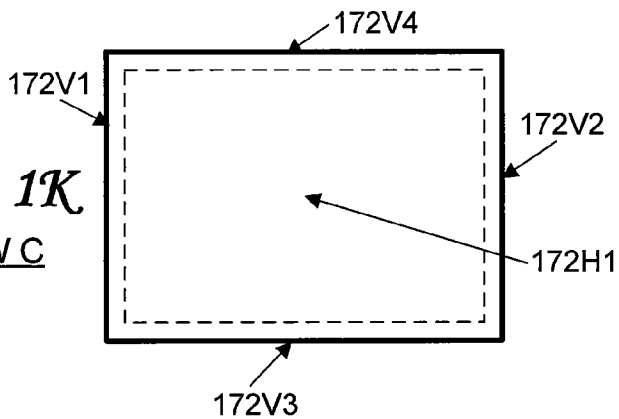
Figure 1M:
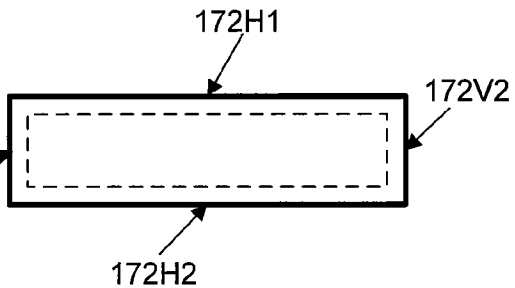
Figure 1O:
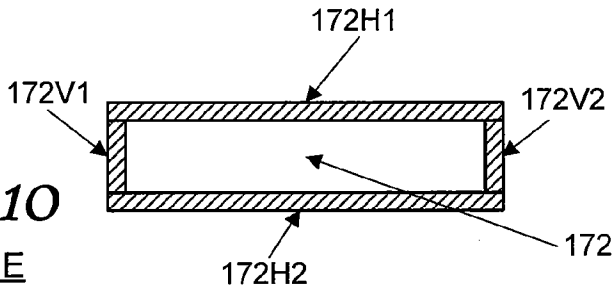

FIG. 1E, FIG. 1F, and FIG. 1G show View C, View D, and View E, respectively, of a rectangular geometrical structure 170 with a horizontal portion 170H, vertical portion 170V1, and vertical portion 170V2. FIG. 1H and FIG. 1I show View C and View D, respectively, of a circular geometrical structure 180 with a horizontal portion 180H and a vertical portion 180V. FIG. 1J shows View E of circular geometrical structure 180. In the cross-sectional view, vertical portion 180V is represented by vertical portion 180V1 and vertical portion 180 V2. View E of circular geometrical structure 180 in FIG. 1J is similar to View E of rectangular geometrical structure 170 in FIG. 1G.

FIG. 1K, FIG. 1L, FIG. 1M, FIG. 1N, and FIG. 1O show View C, View D, View A, View B, and View E, respectively, of closed rectangular cavity 172. The walls of closed rectangular cavity 172 are cavity wall 172H1, cavity wall 172H2, cavity wall 172V1, cavity wall 172V2, cavity wall 172V3, and cavity wall 172V4.

Figure 1Q:
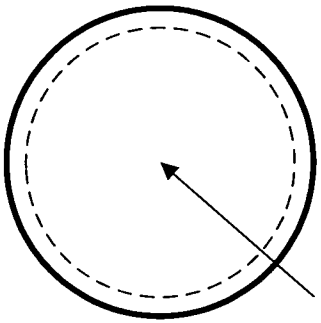
Figure 1S:
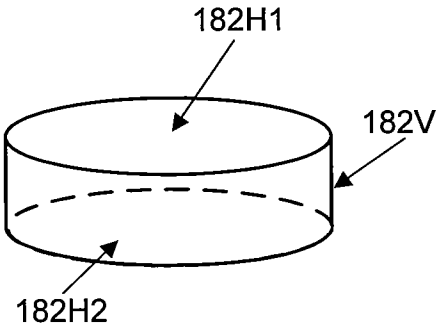
Figure 1P:
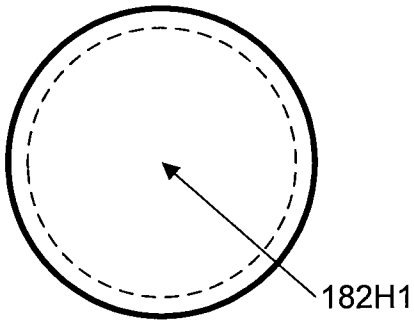
Figure 1R:
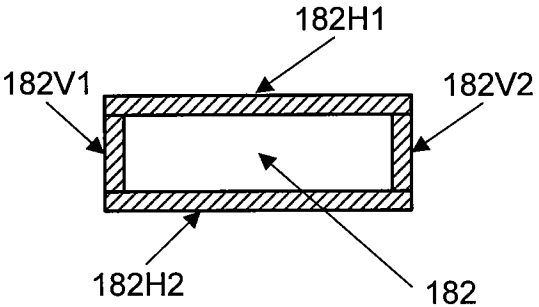

FIG. 1P, FIG. 1Q, and FIG. 1R show View C, View D, and View E, respectively, of closed cylindrical cavity 182. FIG. 1S shows a perspective view. As shown in FIG. 1S, the walls of closed cylindrical cavity 182 are cavity wall 182H1 (planar face), cavity wall 182H2 (planar face), and cavity wall 182V (cylindrical surface). As shown in the cross-sectional View E of FIG. R, the cavity wall 182V is represented by cavity wall 182V1 and cavity wall 182V2.

Embodiments of antenna systems below are shown primarily in cross-sectional view (View E). To reduce the number of figures, unless otherwise stated, the embodiments represent both rectangular geometrical structures and circular geometrical structures. Various embodiments are designed to receive linearly-polarized radiation or circularly-polarized radiation. In general, embodiments of antenna systems disclosed herein are not limited to rectangular and circular geometries. Other examples of geometries include triangle, parallelogram, trapezoid, general polygon, ellipse, and general curvilinear. The geometries are specified by a user (such as an antenna design engineer) for specific applications.

Figure 3A:
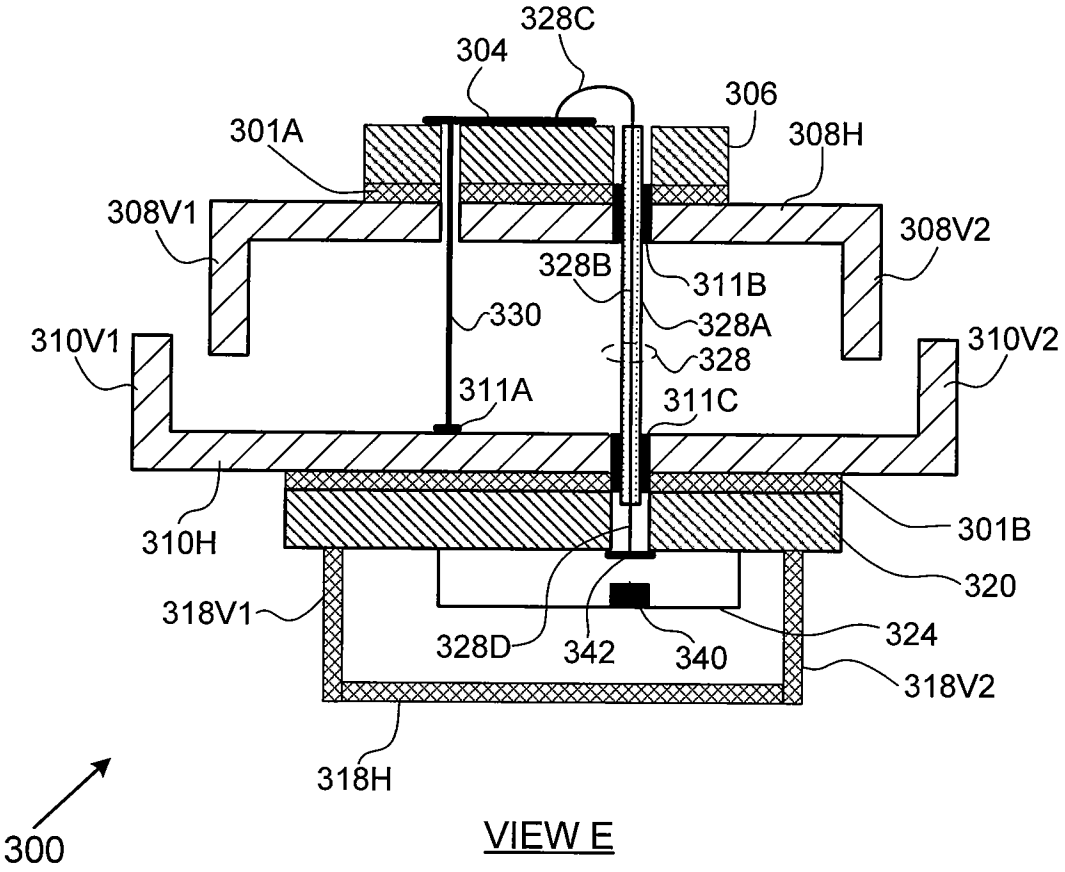
FIG. 3A-3C show cross-sectional views of single-band antenna systems.

FIG. 3A shows close-up details of an embodiment of a patch antenna, referenced as antenna system 300. The principal components are the radiator patch 308H and the corresponding ground plane 310H, which is coaxial with the radiator patch 308H (the axis of the antenna system runs along the z-axis and passes through the geometrical center of the radiator patch and the geometrical center of the ground plane). In antenna system 300, radiator patch 308H and ground plane 310H are separated by air as a dielectric medium. The space between the radiator patch 308H and the ground plane 310H is then referred to as an air gap. When air is used as the dielectric medium, to increase the bandwidth and the directional pattern of antenna system 300, while maintaining a small resonant size, capacitive elements can be configured along the perimeter of radiator patch 308H, along the perimeter of ground plane 310 H, or along the perimeter of radiator patch 308H and along the perimeter of ground plane 310 H. The design of patch antennas incorporating capacitive elements is discussed in further detail in U.S. Patent Application Publication No. US 2009/0140930 (published on Jun. 4, 2009), which is incorporated by reference herein.

In FIG. 3A, along the perimeter of radiator patch 308H are capacitive element 308V1 and capacitive element 308V2. Along the perimeter of ground plane 310H are capacitive element 310V1 and capacitive element 310V2. Circuit board 306 is bonded to radiator patch 308H by metallization layer 301A. Circuit board 306 carries excitation circuit 304. Circuit board 320 is bonded to ground plane 310H by metallization layer 301B. Circuit board 320 carries low-noise amplifier (LNA) 324. In embodiments of antenna systems, the circuit boards are printed circuit boards (PCBs). Exciter 330 is an electrical conductor that couples ground plane 310H (at electrical contact 311A) with excitation circuit 304. Exciter 330 is electrically isolated from radiator patch 308H and metallization layer 301A.

In the embodiment shown in FIG. 3A, a pin-powered excitation circuit is used; other excitation circuits can be used. Excitation circuits are well known in the art and further details are not provided herein (in some embodiments they are implemented as microstrips). For example, other embodiments of excitation circuits incorporate power splitters. Also shown in FIG. 3A is a shield 318 surrounding LNA 324 (in FIG. 3A, shield 318 is represented by shield wall 318H, shield wall 318V1, and shield wall 318V2). The output signals from LNA 324 are accessed via LNA output port 340. Low noise amplifiers are well known in the art and further details are not provided herein. Integrating a LNA into the antenna system itself provides a compact design. In other embodiments, a separate LNA, external to the antenna system, is used.

Coax cable 328 includes outer conductor 328A (for example, a braided conductor jacket) and inner conductor 328B (for example, a wire) separated by a dielectric. Outer conductor 328A makes electrical contact with radiator patch 308H and metallization layer 301A at electrical contact 311B. Outer conductor 328A makes electrical contact with ground plane 310H and metallization layer 301B at electrical contact 311C. One end of inner conductor 328B, referenced as inner conductor end 328C, makes electrical contact with excitation circuit 304. The other end of inner conductor 328B, referenced as inner conductor end 328D, makes electrical contact with LNA input port 342.

In other embodiments, radiator patch 308H and ground plane 310H are separated by a solid dielectric substrate as the dielectric medium. If the permittivity of the solid dielectric medium is $\in$, then the wavelength within the dielectric medium decreases by a factor of $\sqrt{\in}$; consequently, the resonant size of the patch antenna also decreases by a factor of $\sqrt{\in}$. An example of an antenna system incorporating solid dielectric substrates is described below. When a solid dielectric substrate is used, capacitive elements typically are not used.

Antenna systems can operate over a single frequency band (single-band antenna system), over two frequency bands (dual-band antenna system), or over more than two frequency bands (multi-band antenna system). GPS, for example, operates over the L1 band and the L2 band. For GPS, single-band antenna systems typically operate over the L1 band, and dual-band antenna systems typically operate over both the L1 band and the L2 band.

Figure 3B:
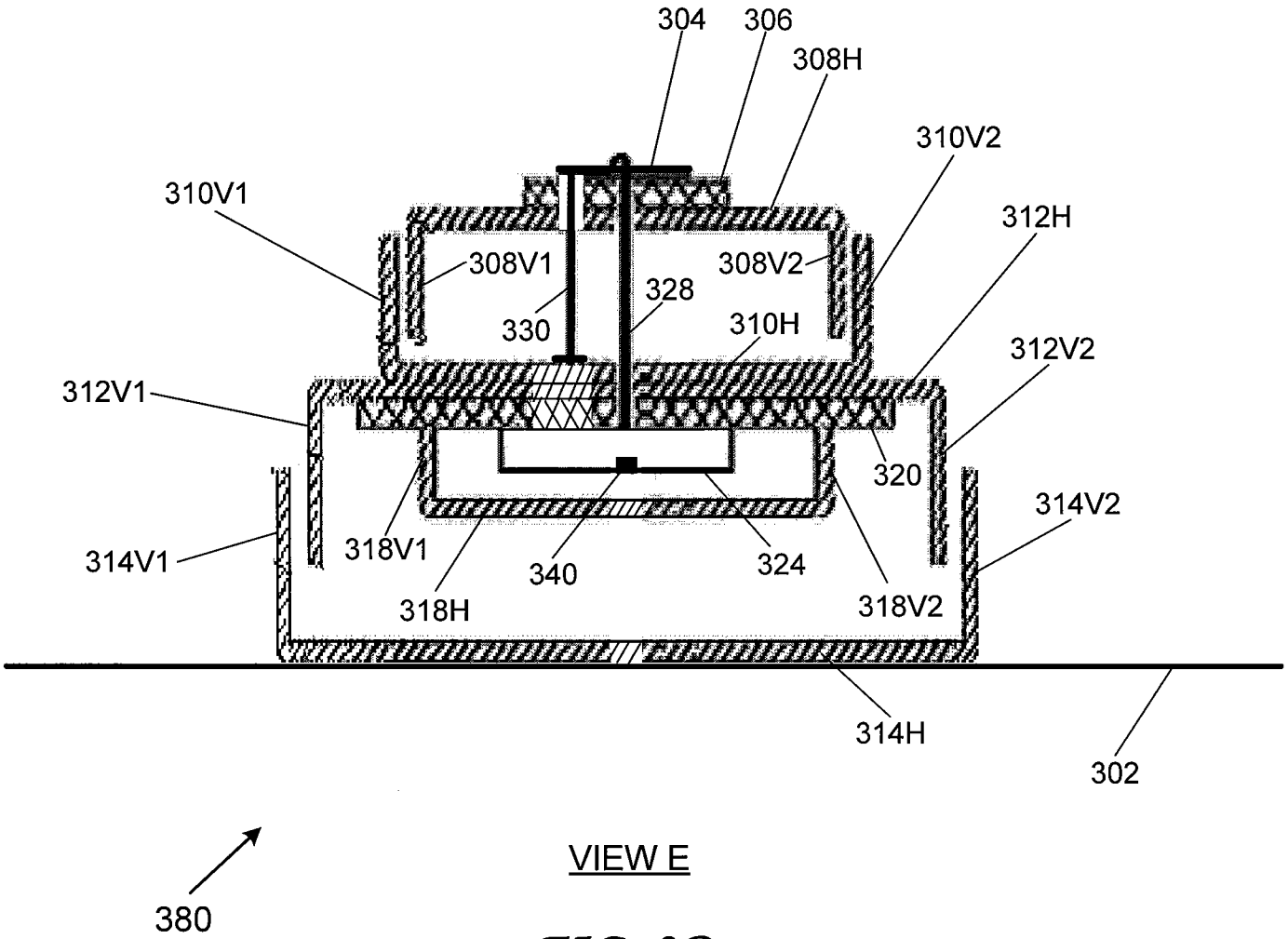

If a prior-art antenna optimized for ground-based applications is positioned on or near the surface of a vehicle, the efficiency of the antenna operation drops, and the multipath level increases. FIG. 3B shows an embodiment of a single-band antenna system, referenced as antenna system 380, designed to maintain high antenna performance when mounted on an arbitrary mounting surface 302. In some embodiments, mounting surface 302 is a conductive surface (herein conductive refers to electrically conductive), such as the roof, hood, or other portion of the body of a vehicle. In other embodiments, mounting surface 302 is a platform on a tripod.

The antenna system 380 includes two corresponding coaxial antenna assemblies. The top antenna assembly is similar to antenna system 300 previously shown in FIG. 3A. To simplify the figure, some the details in FIG. 3A are not shown in FIG. 3B. The corresponding bottom antenna assembly includes radiator patch 314H and corresponding ground plane 312H. Radiator patch 314H and ground plane 312H are separated by an air gap. Along the perimeter of radiator patch 314H are capacitive element 314V1 and capacitive element 314V2. Along the perimeter of ground plane 312H are capacitive element 312V1 and capacitive element 312V2. In general, capacitive elements can be configured along the perimeter of radiator patch 314H, along the perimeter of ground plane 312H, or along the perimeter of radiator patch 314H and along the perimeter of ground plane 312H. The lengths of the capacitive elements and the relative positions of capacitive elements on a radiator patch with respect to capacitive elements on the ground plane can be varied. More details of design parameters are discussed below. In some embodiments, ground plane 310H and ground plane 312H are separate structures in electrical contact with one another; in other embodiments, ground plane 310H and ground plane 312H are formed as a single structure.

In the top antenna assembly, radiofrequency (RF) signals are excited in radiator patch 308H by exciter 330 and excitation circuit 304. Output signals from excitation circuit 304 are coupled to the input port of LNA 324 via coax cable 328. A coax cable can be used to couple LNA output port 340 to a navigation receiver or other electronic assembly. Note that the LNA can be mounted at other locations within the antenna system (between the radiator patch 308H and the radiator patch 314H).

In the bottom antenna assembly, there are no exciter and no excitation circuit. The bottom antenna assembly is electromagnetically coupled to the top antenna assembly, and electromagnetic radiation in the bottom antenna assembly is induced by electromagnetic radiation from the top antenna assembly. Electromagnetic radiation from the bottom radiator patch is transmitted back to the top radiator patch via electromagnetic coupling and the signal from the bottom radiator patch is combined with the signal excited at the top radiator patch.

Herein, a signal port refers to an access point at which the combined signal from the top radiator patch and the bottom radiator patch can be accessed. The signal port can correspond to various physical ports. Referring back to FIG. 3A, the signal port can be located, for example, at inner conductor end 328D, LNA input port 342, or LNA output port 340. In FIG. 3B, note that the top radiator patch 308H is electrically connected to the signal port but the bottom radiator patch 314H is electromagnetically coupled to the signal port (as described above, the bottom antenna assembly is electromagnetically coupled to the top antenna assembly). The electromagnetic coupling between the top radiator patch 308H and the signal port is therefore stronger than the electromagnetic coupling between the bottom radiator patch 316H and the signal port.

The bottom antenna assembly is configured such that its resonant frequency is approximately equal to the resonant frequency of the top antenna assembly. The resonant frequency of the top antenna assembly is tuned to the central operational frequency of the frequency band. In an embodiment, the top antenna assembly operates in the GPS L1 band. The resonant frequency of the bottom antenna assembly is then tuned to be within approximately +/−5% of the resonant frequency of the top antenna assembly.

The top antenna assembly and the bottom antenna assembly are configured such that the fields of the currents induced in the bottom antenna assembly are in phase opposition to the fields of the currents excited in the top antenna assembly. Therefore, the amplitudes of the fields in the bottom hemisphere of the antenna system are subtracted from the amplitudes of the fields in the top hemisphere of the antenna system. The combination of an actively excited top antenna assembly coupled to a passively excited (through electromagnetic induction from the top antenna assembly) bottom antenna assembly, in which the resonant frequency of the bottom antenna assembly is tuned to the resonant frequency of the top antenna element, reduces the received number of signals reflected from the underlying surface on which the antenna system is mounted. Consequently, the antenna directional pattern level in the bottom hemisphere is reduced and reflected multipath signals are suppressed.

The resonant frequency of the bottom antenna assembly can be measured with an auxiliary RF probe (the top antenna assembly is first removed). The total input resistance as a function of frequency is measured by the auxiliary probe. The frequency with a maximum in the real part of the total input resistance shows the resonant frequency. Final tuning of the radiator patch dimensions for the top antenna assembly and the bottom antenna assembly can be performed to minimize the down/up ratio. The down/up ratio as a function of frequency is measured in an echo-free chamber. In an embodiment, the minimum of the down/up ratio can be shifted to the desired frequency by adjusting the geometrical configuration of the capacitive elements in the bottom antenna assembly (for example, changing the positions and orientations of the capacitive elements relative to one another and relative to the radiator patch and the ground plane).

In an embodiment in which the radiator patch and the ground plane of the bottom antenna assembly are separated by a solid dielectric substrate instead of an air gap, the frequency at which the down/up ratio is a minimum can be tuned by varying the permittivity of the dielectric.

Figure 3C:
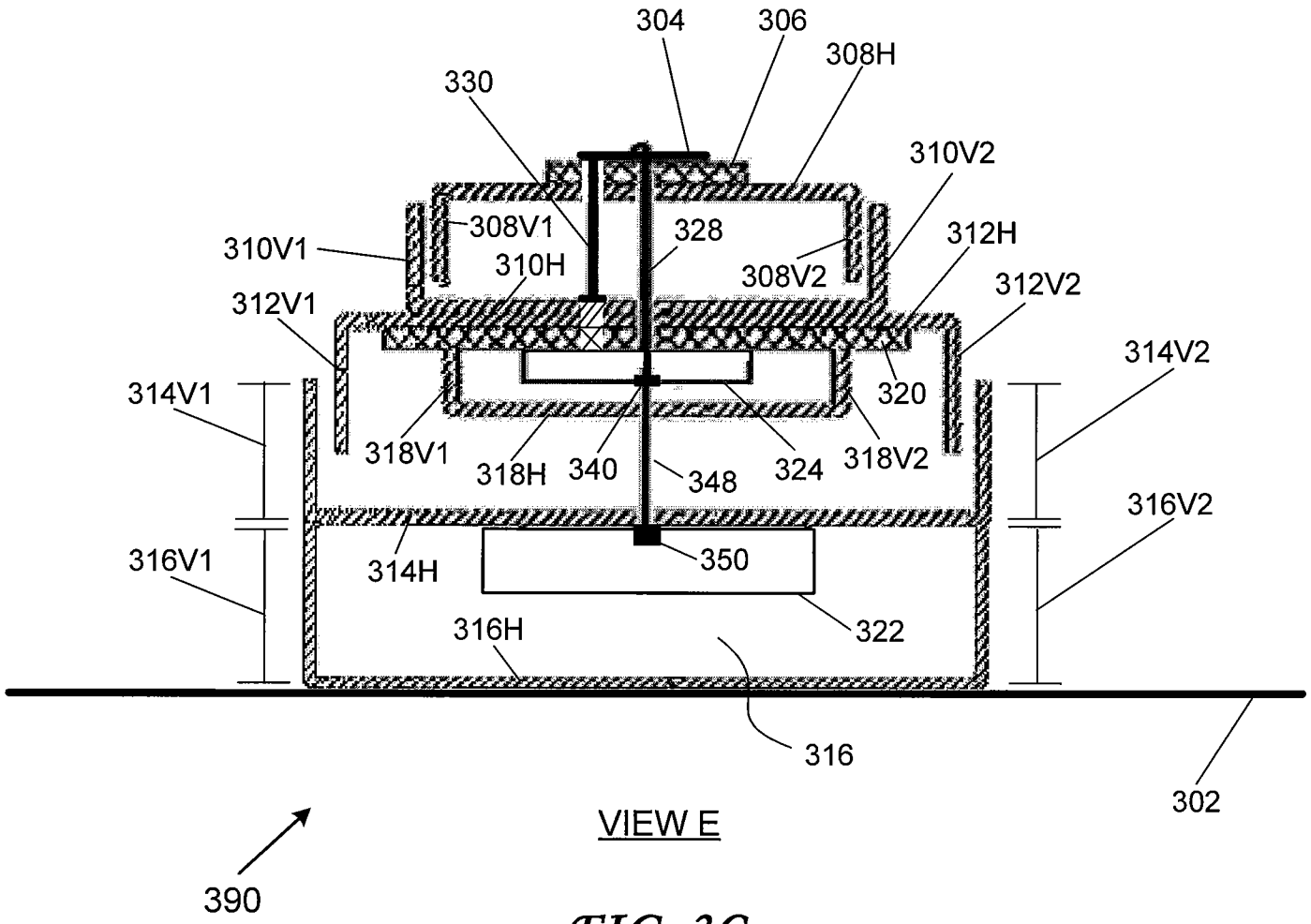

FIG. 3C shows an embodiment of a single-band antenna system, referenced as antenna system 390, mounted on mounting surface 302. Antenna system 390 includes antenna system 380, with additional elements. A closed cavity 316 is formed in part by radiator patch 314H, cavity wall 316H, cavity wall 316V1, and cavity wall 316V2. The cavity walls are electrically conductive. Mounted inside cavity 316 is navigation receiver 322. Coax cable 348 couples LNA output port 340 to input port 350 of navigation receiver 322. Note that the combined radiator patch 314H, cavity wall 316V1, cavity wall 316V2, and cavity wall 316H now function as the radiator patch for the bottom antenna assembly. Additional cavities (not shown) can be configured below cavity 316 in a stacked configuration. Auxiliary units (discussed below) can be mounted in these cavities. The sizes of the cavities can be the same or can be different. Mounting a navigation receiver or other auxiliary units within cavities integrated into the antenna system provides a compact design without affecting the performance of the antenna system.

Figure 4:
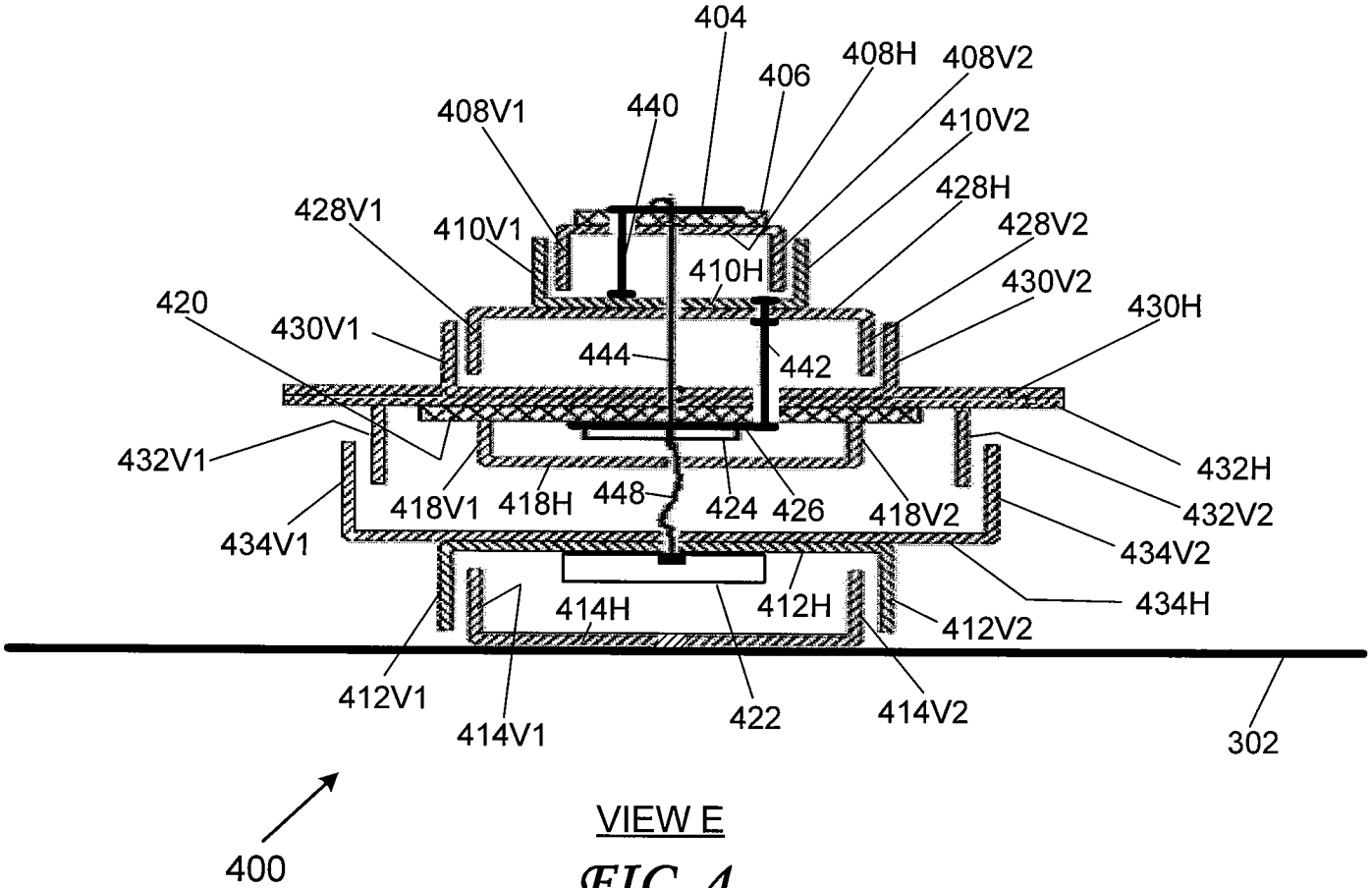
FIG. 4 shows a cross-sectional view of a dual-band antenna system in which the radiator patches and ground planes are separated by air gaps.

FIG. 4 shows an embodiment of a dual-band antenna system, referenced as antenna system 400. For each frequency band, there is a top antenna assembly and a corresponding bottom antenna assembly. Each antenna assembly includes a radiator patch and a corresponding ground plane separated by an air gap. For each antenna assembly, capacitive elements can be configured along the perimeter of the radiator patch, along the perimeter of the ground plane, or along the perimeter of the radiator patch and along the perimeter of the ground plane. In an embodiment, the first frequency band is the GPS L1 band (high-frequency band) and the second frequency band is the GPS L2 band (low-frequency band).

For the first frequency band, the top antenna assembly includes radiator patch 408H and corresponding ground plane 410H. Along the perimeter of radiator patch 408H are capacitive element 408V1 and capacitive element 408V2. Along the perimeter of ground plane 410H are capacitive element 410V1 and capacitive element 410V2.

For the first frequency band, the corresponding bottom antenna assembly includes radiator patch 414H and corresponding ground plane 412H. Along the perimeter of radiator patch 414H are capacitive element 414V1 and capacitive element 414V2. Along the perimeter of ground plane 412H are capacitive element 412V1 and capacitive element 412V2.

For the second frequency band, the top antenna assembly includes radiator patch 428H and corresponding ground plane 430H. Along the perimeter of radiator patch 428H are capacitive element 428V1 and capacitive element 428V2. Along the perimeter of ground plane 430H are capacitive element 430V1 and capacitive element 430V2.

For the second frequency band, the corresponding bottom antenna assembly includes radiator patch 434H and corresponding ground plane 432H. Along the perimeter of radiator patch 434H are capacitive element 434V1 and capacitive element 434V2. Along the perimeter of ground plane 432H are capacitive element 432V1 and capacitive element 432V2.

Ground plane 410H and radiator patch 428H can be separate structures in electrical contact with one another or can be formed as a single structure. Ground plane 430H and ground plane 432H can be separate structures in electrical contact with one another or can be formed as a single structure. Radiator patch 434H and ground plane 412H can be separate structures in electrical contact with one another or can be formed as a single structure.

Circuit board 406 is bonded to radiator patch 408H by a metallization layer (not shown). Circuit board 406 carries the excitation circuit 404 for the first frequency band. Circuit board 420 is bonded to ground plane 432H by a metallization layer (not shown). Circuit board 420 carries low-noise amplifier (LNA) 424 and the excitation circuit 426 for the second frequency band. Exciter 440, the exciter for the first frequency band, is an electrical conductor that couples ground plane 410H with excitation circuit 404. Exciter 440 is electrically isolated from radiator patch 408H (and the metallization layer).

Exciter 442, the exciter for the second frequency band, couples radiator patch 428H to excitation circuit 426. In the embodiment shown in FIG. 4, a single wideband LNA is used to process signals in both the first frequency band and the second frequency band. The output port of the wideband LNA serves as a common signal port for both frequency bands. In general, a separate LNA can be used for each frequency band; the signal port for the first frequency band is then separate from the signal port for the second frequency band. A single wideband LNA provides a more compact design than separate LNAs. Note that the LNA can be mounted at other locations within the antenna system (between the radiator patch 408H and the radiator patch 414H).

For the first frequency band, radiator patch 406H of the top antenna assembly is electrically connected to the first signal port (which in this instance is the common signal port); radiator patch 414H of the corresponding bottom antenna assembly is not. The bottom antenna assembly is electromagnetically coupled to the top antenna assembly. The degree of electromagnetic coupling can be varied by varying the geometric configuration of the antenna system; for example, by varying the axial separation between radiator patch 406H and radiator patch 414H. The electromagnetic coupling between radiator patch 406H and the first signal port is stronger than the electromagnetic coupling between radiator patch 414H and the first signal port. As discussed above, the multipath signal is suppressed because the amplitudes of the fields in the bottom hemisphere of the antenna system are subtracted from the amplitudes of the fields in the top hemisphere of the antenna system.

The antenna elements for the second frequency band are similarly configured. For the second frequency band, radiator patch 428H of the top antenna assembly is electrically connected to the second signal port (which in this instance is the common signal port); radiator patch 434H of the corresponding bottom antenna assembly is not. The bottom antenna assembly is electromagnetically coupled to the top antenna assembly. The degree of electromagnetic coupling can be varied by varying the geometric configuration of the antenna system; for example, by varying the axial separation between radiator patch 428H and radiator patch 434H. The electromagnetic coupling between radiator patch 428H and the second signal port is stronger than the electromagnetic coupling between radiator patch 434H and the second signal port. As discussed above, the multipath signal is suppressed because the amplitudes of the fields in the bottom hemisphere of the antenna system are subtracted from the amplitudes of the fields in the top hemisphere of the antenna system.

In the figures for the embodiments of antenna systems herein, various signal and power connections and cables used for operation of LNAs, navigation receivers, and auxiliary units are not shown. These are well known in the art and are not described herein.

Figure 5:
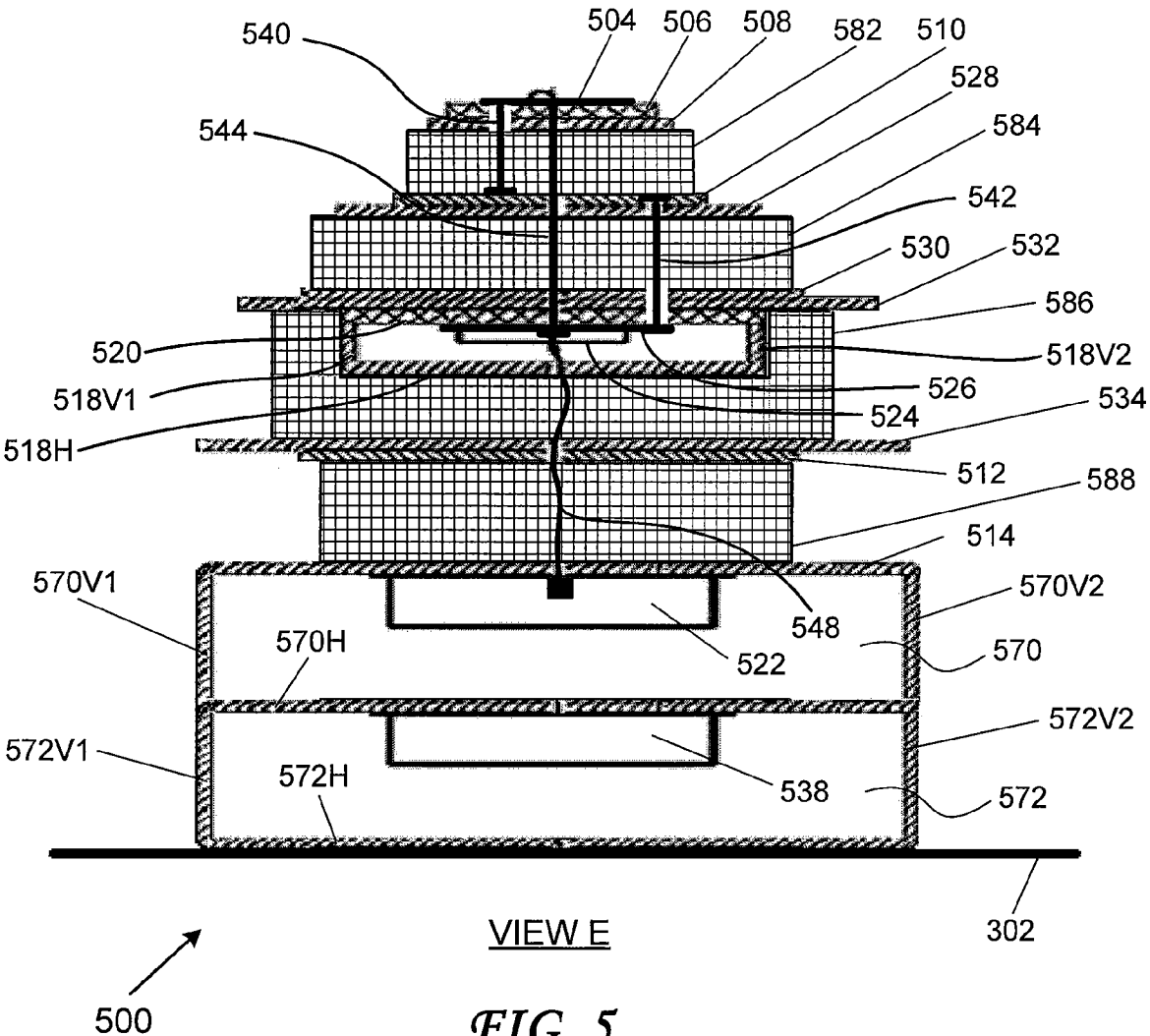
FIG. 5 shows a cross-sectional view of a dual-band antenna system in which the radiator patches and ground planes are separated by solid dielectric substrates.

FIG. 5 shows an embodiment of a dual-band antenna system, referenced as antenna system 500. For each frequency band, there is a top antenna assembly and a corresponding bottom antenna assembly. Each antenna assembly includes a radiator patch and a corresponding ground plane. The various radiator patches and ground planes are separated by solid dielectric substrates instead of air gaps. No capacitive elements are used.

For the first frequency band, the top antenna assembly includes radiator patch 508 and corresponding ground plane 510. For the first frequency band, the corresponding bottom antenna assembly includes radiator patch 514 and corresponding ground plane 512. For the second frequency band, the top antenna assembly includes radiator patch 528 and corresponding ground plane 530. For the second frequency band, the corresponding bottom antenna assembly includes radiator patch 534 and corresponding ground plane 532.

Ground plane 510 and radiator patch 528 can be separate structures in electrical contact with one another or can be formed as a single structure. Ground plane 530 and ground plane 532 can be separate structures in electrical contact with one another or can be formed as a single structure. Radiator patch 534 and ground plane 512 can be separate structures in electrical contact with one another or can be formed as a single structure.

Radiator patch 508 and ground plane 510 are separated by solid dielectric substrate 582. Radiator patch 528 and ground plane 530 are separated by solid dielectric substrate 584. Ground plane 532 and radiator patch 534 are separated by solid dielectric substrate 586. Ground plane 512 and radiator patch 514 are separated by solid dielectric substrate 588. The dielectric substrates can either be same material or different materials (with different permittivities, for example).

Circuit board 506 is bonded to radiator patch 508 by a metallization layer (not shown). Circuit board 506 carries the excitation circuit 504 for the first frequency band. Circuit board 520 is bonded to ground plane 532 by a metallization layer (not shown). Circuit board 526 carries low-noise amplifier (LNA) 524 and excitation circuit 526 for the second frequency band. Exciter 540 is an electrical conductor that couples ground plane 510 with excitation circuit 504. Exciter 540 is electrically isolated from radiator patch 508 (and the metallization layer). Exciter 542 couples radiator patch 528 to excitation circuit 526. Coax cable 548 couples the output of LNA 524 to the input of navigation receiver 522.

Closed cavity 570 is formed in part by radiator patch 514, cavity wall 570H, cavity wall 570V1, and cavity wall 570V2. Closed cavity 572 is formed in part by cavity wall 570H, cavity wall 572V1, cavity wall 572V2, and cavity wall 572H. The cavity walls are electrically conductive. Mounted inside cavity 570 is navigation receiver 522. Mounted inside cavity 572 is an auxiliary unit 538. Herein, an auxiliary unit refers to any user-defined component, including electrical, electronic, optical, and mechanical components. Examples of auxiliary unit 538 include low-noise amplifiers, signal processors, attitude transducers, and tilt sensors. Additional cavities can be configured below cavity 572 in a stacked configuration. The sizes of the cavities can be the same or can be different. Various signal and power connections and cables used for operation of navigation receivers and auxiliary units are not shown.

One skilled in the art can develop embodiments of antenna systems for operating in more than two frequency bands.

Figure 6:
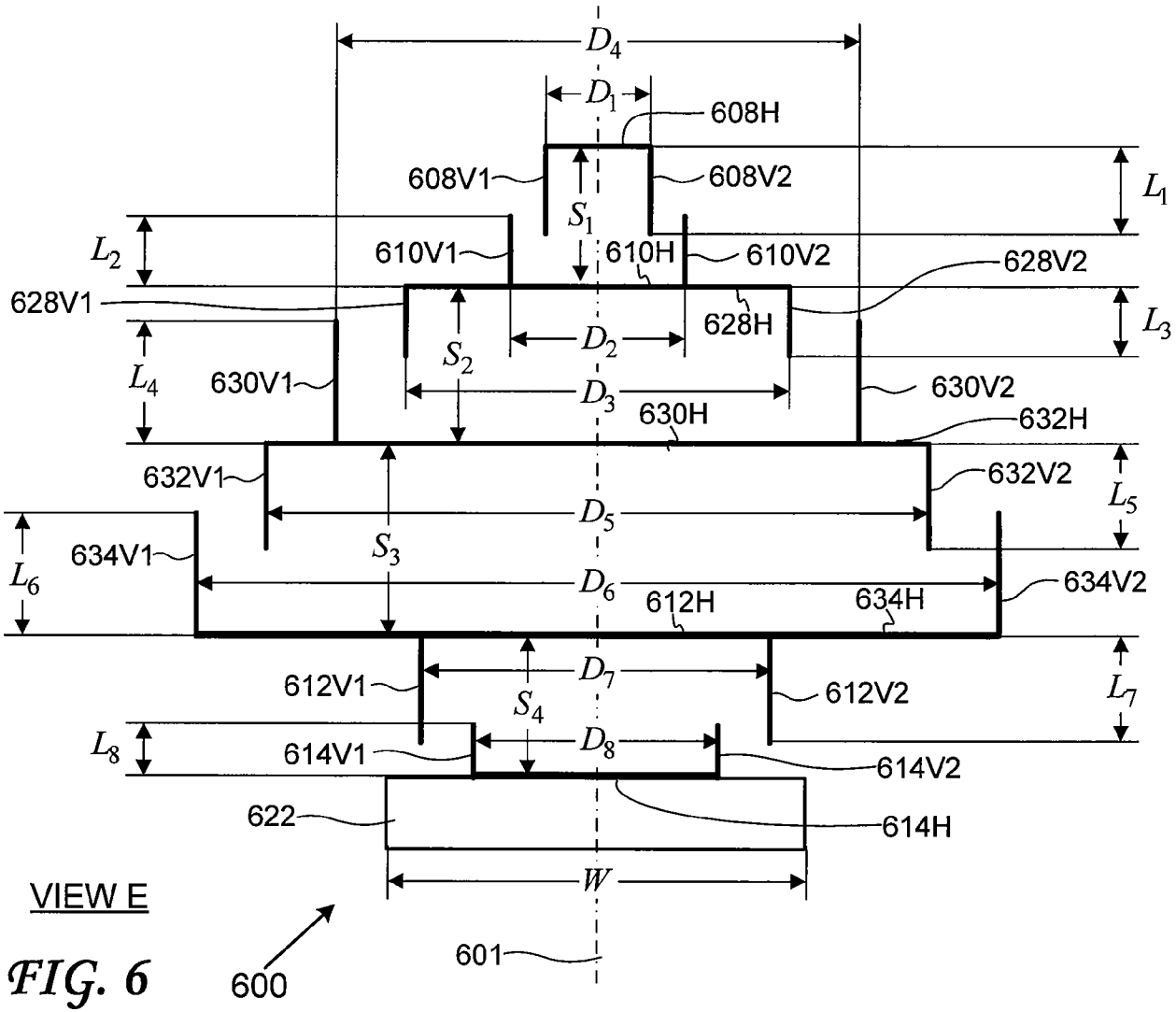
FIG. 6 shows design parameters of a dual-band antenna system.

FIG. 6 shows a dimensional schematic of a dual-band antenna system, referenced as antenna system 600. To simplify the figure, most of the circuit elements are not shown. For each frequency band, there is a top antenna assembly and a corresponding bottom antenna assembly, which are coaxial about axis 601. Each antenna assembly includes a radiator patch and a corresponding ground plane separated by an air gap. For each antenna assembly, capacitive elements can be configured along the perimeter of the radiator patch, along the perimeter of the ground plane, or along the perimeter of the radiator patch and along the perimeter of the ground plane.

For the first frequency band, the top antenna assembly includes radiator patch 608H and corresponding ground plane 610H. Along the perimeter of radiator patch 608H are capacitive element 608V1 and capacitive element 608V2. Along the perimeter of ground plane 610H are capacitive element 610V1 and capacitive element 610V2.

For the first frequency band, the corresponding bottom antenna assembly includes radiator patch 614H and corresponding ground plane 612H. Along the perimeter of radiator patch 614H are capacitive element 614V1 and capacitive element 614V2. Along the perimeter of ground plane 612H are capacitive element 612V1 and capacitive element 612V2.

For the second frequency band, the top antenna assembly includes radiator patch 628H and corresponding ground plane 630H. Along the perimeter of radiator patch 628H are capacitive element 628V1 and capacitive element 628V2. Along the perimeter of ground plane 630H are capacitive element 630V1 and capacitive element 630V2.

For the second frequency band, the corresponding bottom antenna assembly includes radiator patch 634H and corresponding ground plane 632H. Along the perimeter of radiator patch 634H are capacitive element 634V1 and capacitive element 634V2. Along the perimeter of ground plane 632H are capacitive element 632V1 and capacitive element 632V2.

Ground plane 610H and radiator patch 628H can be separate structures in electrical contact with one another or can be formed as a single structure. Ground plane 630H and ground plane 632H can be separate structures in electrical contact with one another or can be formed as a single structure. Radiator patch 634H and ground plane 612H can be separate structures in electrical contact with one another or can be formed as a single structure.

The following dimensions are design parameters which can be specified by a user (such as an antenna engineer) for specific applications:

Lateral dimensions of radiator patches and ground planes:

- $D_1$: radiator patch 608H
- $D_2$: ground plane 610H
- $D_3$: radiator patch 628H
- $D_4$: ground plane 630H
- $D_5$: ground plane 632H
- $D_6$: radiator patch 634H
- $D_7$: ground plane 612H
- $D_8$: radiator patch 614H Lengths of capacitive elements:

- $L_1$: capacitive element 608V1 and capacitive element 608V2
- $L_2$: capacitive element 610V1 and capacitive element 610V2
- $L_3$: capacitive element 628V1 and capacitive element 628V2
- $L_4$: capacitive element 630V1 and capacitive element 630V2
- $L_5$: capacitive element 632V1 and capacitive element 632V2
- $L_6$: capacitive element 634V1 and capacitive element 634V2
- $L_7$: capacitive element 612V1 and capacitive element 612V2
- $L_8$: capacitive element 614V1 and capacitive element 614V2

Vertical spacings between radiator patches and ground planes:

- $S_1$: between radiator patch 608H and ground plane 610H
- $S_2$: between radiator patch 628H and ground plane 630H
- $S_3$: between ground plane 632H and radiator patch 634H
- $S_4$: between ground plane 612H and radiator patch 614H.

In an embodiment of an antenna system, the first frequency band is the L1 band, and the second frequency band is the L2 band. The top antenna assembly and the corresponding bottom antenna assembly of the first frequency band are configured to provide a user-specified down/up ratio in the L1 band, and the top antenna assembly and the corresponding bottom antenna assembly of the second frequency band are configured to provide a user-specified down/up ratio in the L2 band. For example, to receive both GPS and GLONASS signals in the L1 band (1563 MHz-1616 MHz) and L2 band (1216 MHz-1260 MHz), the parameters are selected such that the resonant frequency of bottom antenna assembly in the L1 band is approximately within a range of −60 MHz to +25 MHz about the central frequency of the L1 band (1590 MHz), and the resonant frequency of bottom antenna assembly of the L2 band is approximately within a range of −50 MHz to +20 MHz about the central frequency of the L2 band (1240 MHz).

Also shown in FIG. 6 is housing 622, with a lateral dimension W, a user-specified parameter. In one embodiment, housing 622 is a closed cavity, such as closed cavity 316 in FIG. 3C. In another embodiment, housing 622 is the case of a navigation receiver, such as navigation receiver 322 in FIG. 3C. The case of the navigation receiver is electrically conductive and makes electrical contact with radiator patch 614H; a closed cavity is not used. Different dimensions of housing 622 can be used without affecting the performance characteristics of the antenna system. In one embodiment, W ranges from approximately $(1\text{-}5)/D_6$; in a second embodiment, W is approximately equal to $D_6$; in a third embodiment, W is approximately equal to $D_8$.

In one embodiment, housing 622 represents a closed cavity, the antenna assembly is mounted on a jack pad or tripod, and W is less than $D_7$. If additional cavities are mounted below housing 622, the dimensions of the additional cavities are less than or equal to W. In a second embodiment, the antenna assembly is mounted on a conductive surface, such as the body of a vehicle, and W is greater than or equal to $D_6$. If additional cavities are mounted below housing 622, the dimensions of the additional cavities do not affect the performance of the antenna system.

Note that the lateral dimensions shown in FIG. 6 represent the lateral dimensions in the cross-sectional plane of View E. As discussed above, however, the geometries of the radiator patches and ground planes can be different from a square or a circle. Therefore, the lateral dimensions can be different for other cross-sections.

In other embodiments, a radiator patch and its corresponding ground plane are separated by a solid dielectric substrate instead of an air gap. Capacitive elements are typically not used in these embodiments. Design parameters, similar to those shown in FIG. 6, apply. Additional design parameters include the permittivities of the solid dielectric substrates.

Figure 8A:
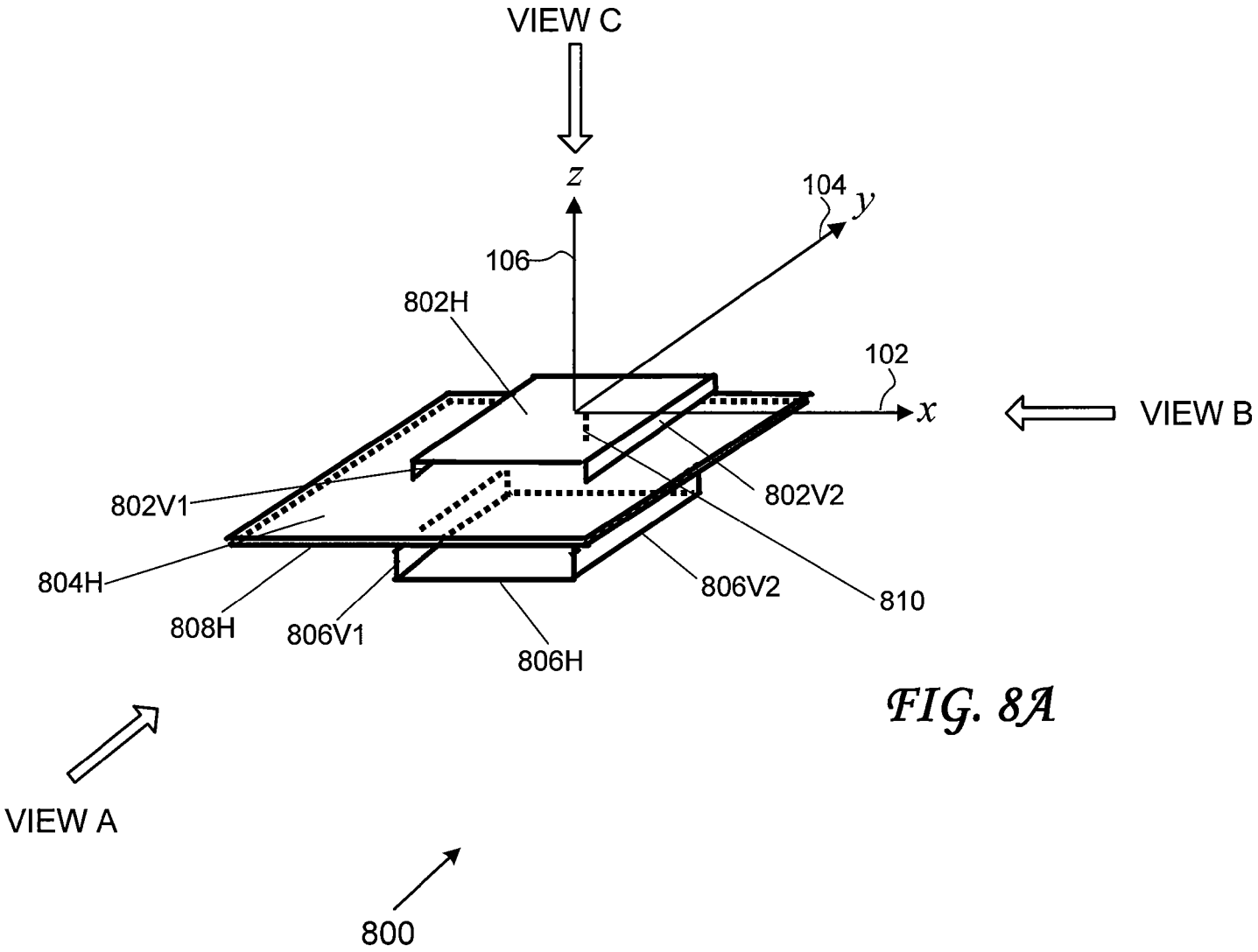
FIG. 8A shows a perspective view of a single-band, linearly-polarized antenna system.

FIG. 8A shows a perspective view of an embodiment of a single-band antenna system, referenced as antenna system 800, for linearly-polarized radiation. The antenna system 800 includes a top antenna assembly (radiator patch 802H and corresponding ground plane 804H) and a corresponding bottom antenna assembly (radiator patch 806H and corresponding ground plane 808H). Ground plane 804H and ground plane 808H can be separate structures in electrical contact with one another or can be formed from a single structure. Radiator patch 802H is fed by exciter 810. The location of exciter 810 is shifted from the geometrical center of radiator patch 802H along the x-axis. Radiator patch 806H is not fed by an exciter.

A radiator patch is separated from its corresponding ground plane by a dielectric medium. In some embodiments, the dielectric medium is a solid dielectric substrate. In other embodiments, as shown in FIG. 8A, the dielectric medium is air. Structural elements that support a radiator patch over a ground plane are not shown in these figures. Examples of supporting structural elements include thin dielectric standoffs and thin conducting bridges; these do not affect the performance of the antenna system.

When an air gap is used, slow-wave structures in the form of capacitive elements can be configured on the radiator patch, on the ground plane, or on both the radiator patch and the ground plane, to reduce the resonant size of the patch antenna. The capacitive elements are configured only along the H-plane (orthogonal to the x-axis). In the embodiment shown in FIG. 8A, the capacitive elements (CE) are CE 802V1 and CE 802V2 configured on top radiator patch 802H and CE 806V1 and CE 806V2 configured on bottom radiator patch 806H.

Reference geometries are described below. Unless otherwise noted, all the dimensions herein are design parameters that can be user-specified for specific applications.

FIG. 8B provides reference geometries for radiator patch 802H and ground plane 804H. Refer to View C. Ground plane 804H has dimension $d_1$ along the x-axis and dimension $d_2$ along the y-axis. Radiator patch 802H has dimension $d_3$ along the x-axis and dimension $d_4$ along the y-axis. The dimensions of the radiator patch 802H can be less than, equal to, or greater than the dimensions of ground plane 804H. To improve the down/up ratio of the antenna system, typically $d_1=\sim(1\text{-}3.5)d_3$ and $d_2=\sim(1\text{-}3.5)d_4$.

Refer to View B and View A. Radiator patch 802H is separated from ground plane 804H by dimension $d_6$ along the z-axis. Capacitive elements CE 802V1 and CE 802V2 have dimension $d_4$ along the y-axis and dimension $d_5$ along the z-axis.

A similar reference geometry applies for radiator patch 806H and ground plane 808H. In one embodiment, radiator patch 806H is the same size as radiator patch 802H, and the ground plane 808H is the same size as ground plane 804H: the bottom antenna assembly and the top antenna assembly have mirror symmetry with respect to the x-y plane. In general, the dimensions of the bottom antenna assembly can be less than, equal to, or greater than the corresponding dimensions in the top antenna assembly. In one embodiment, to reduce the down/up ratio, the dimensions of the bottom antenna assembly are up to approximately 3.5 times greater than the corresponding dimensions in the top antenna assembly.

FIG. 9A-FIG. 9D show other embodiments of capacitive elements, which are described in further detail in U.S. Patent Application Publication No. US 2009/0140930. Refer to FIG. 9A. Radiator patch 802H has dimension $d_4$ along the y-axis. In FIG. 8B, CE 802V2 ran along the full length of radiator patch 802H. In general, CE 902V2 has a dimension $d_7$ along the y-axis, where $d_7 \leq d_4$.

Refer to FIG. 9B-FIG. 9D. In FIG. 9B, CE 902S1 and CE 902S2 have a straight profile. The thickness of a capacitive element is denoted dimension $d_9$. In FIG. 9C, CE 902I1 (including segment 902I1-1 and segment 902I1-2) and CE 902I2 (including segment 902I2-1 and segment 902I2-2) have an inwardly-bent profile. The dimension of segment 902I1-2 and segment 902I2-2 is $d_{10}$ along the x-axis. In FIG. 9C, CE 902O1 (including segment 902O1-1 and segment 902O1-2) and CE 902O2 (including segment 902O2-1 and segment 902O2-2) have an outwardly-bent profile. The dimension of segment 902O1-2 and segment 902O2-2 is $d_{11}$ along the x-axis. In general, the angle between a capacitive element and a radiator patch or ground plane can vary from 90 degrees. In general, the bend angles for inwardly-bent and outwardly-bent capacitive elements can vary from 90 degrees.

In FIG. 9B, FIG. 9C, and FIG. 9D, the distance between capacitive elements along the x-axis is $d_8$.

Capacitive element CE 902V2 is configured as a continuous strip and is referred to as an extended continuous structure (ECS). The profile shown in FIG. 9B is referred to as a straight ECS. The profile shown in FIG. 9C is referred to as an inwardly-bent ECS. The profile shown in FIG. 9D is referred to as an outwardly-bent ECS.

FIG. 9E-FIG. 9L show orthogonal views of various configurations of radiator patches, ground planes, and ECS capacitive elements.

Figure 9E:
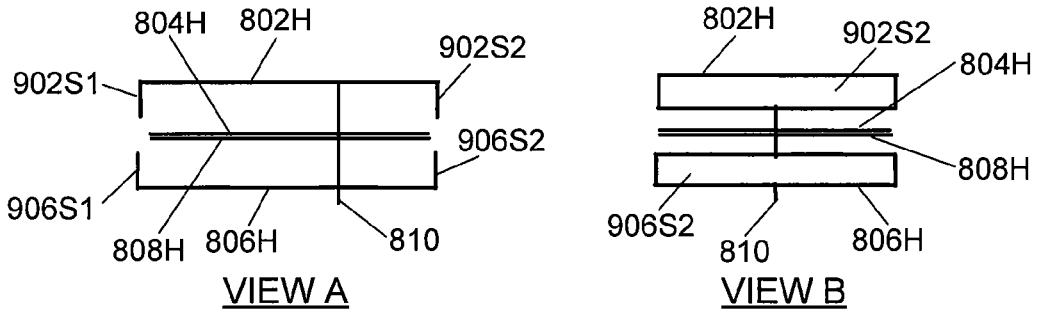
FIG. 9E-FIG. 9L show orthogonal views of different embodiments of extended continuous structures configured on radiator patches and ground planes for a single-band, linearly-polarized antenna system.

FIG. 9E:
Radiator patch 802H: straight ECS (902S1, 902S2)
Ground plane 804H: none
Ground plane 808H: none
Radiator patch 806H: straight ECS (906S1, 90262)
Notes: none.

Figure 9F:
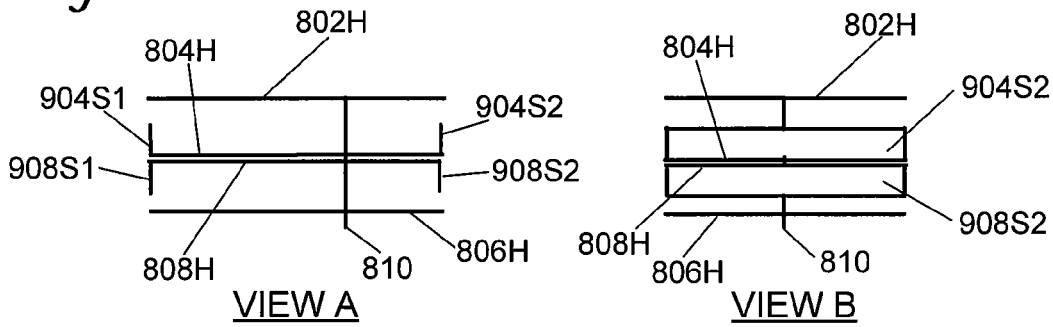

FIG. 9F:
Radiator patch 802H: none
Ground plane 804H: straight ECS (904S1, 904S2)
Ground plane 808H: straight ECS (908S1, 908S2)
Radiator patch 806H: none
Notes: none.

Figure 9G:
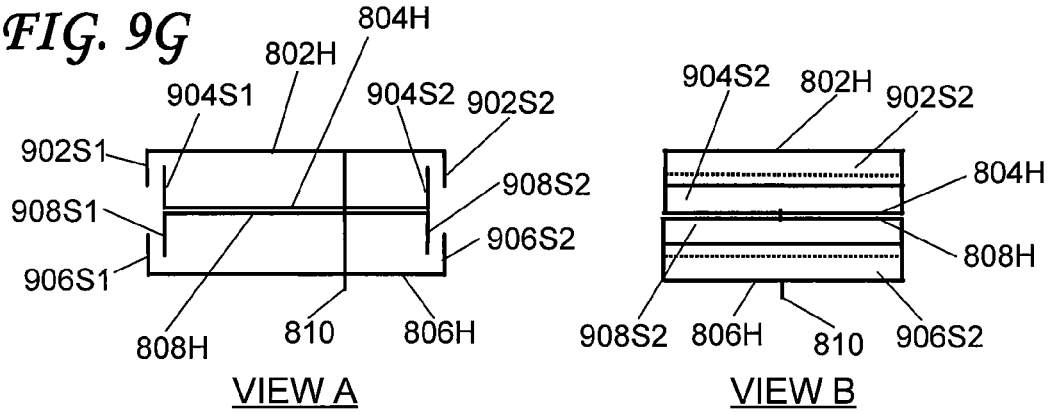

FIG. 9G:
Radiator patch 802H: straight ECS (902S1, 902S2)
Ground plane 804H: straight ECS (904S1, 904S2)
Ground plane 808H: straight ECS (908S1, 908S2)
Radiator patch 806H: straight ECS (906S1, 906S2)
Notes: Radiator patches larger than ground planes.

Figure 9H:
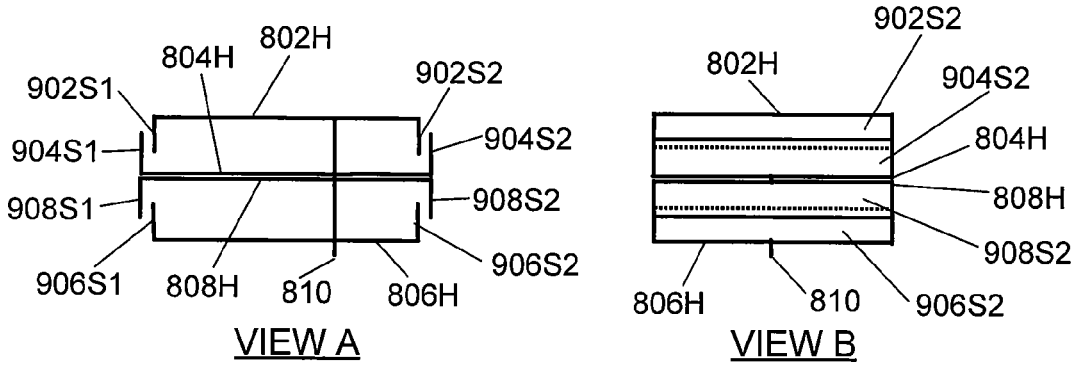

FIG. 9H:
Radiator patch 802H: straight ECS (902S1, 902S2)
Ground plane 804H: straight ECS (904S1, 904S2)
Ground plane 808H: straight ECS (908S1, 908S2)
Radiator patch 806H: straight ECS (906S1, 906S2)
Notes: Ground planes larger than radiator patches.

Figure 9I:
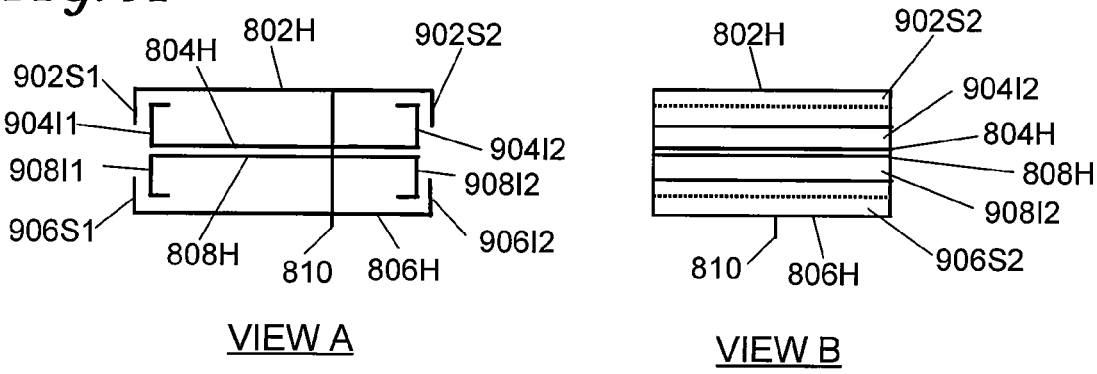

FIG. 9I:
Radiator patch 802H: straight ECS (902S1, 902S2)
Ground plane 804H: inwardly-bent ECS (904I1, 904I2)
Ground plane 808H: inwardly-bent ECS (908I1, 908I2)
Radiator patch 806H: straight ECS (906S1, 906S2)
Notes: Radiator patches larger than ground planes.

Figure 9J:
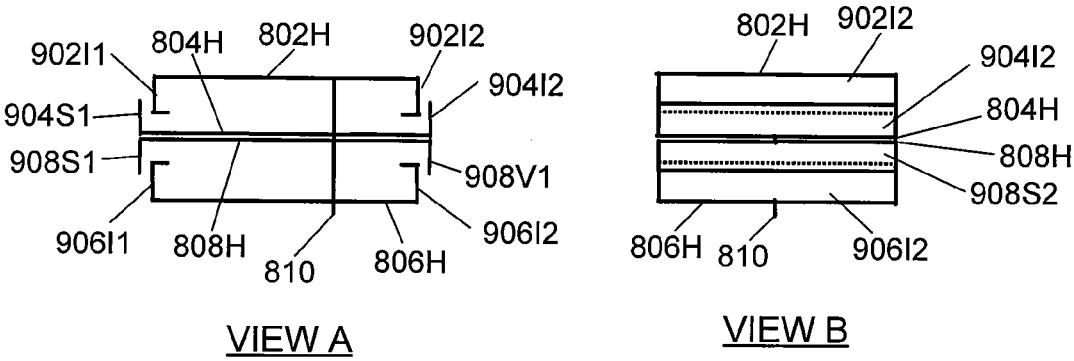

FIG. 9J:
Radiator patch 802H: inwardly-bent ECS (902I1, 902I2)
Ground plane 804H: straight ECS (904S1, 904S2)
Ground plane 808H: straight ECS (908S1, 908S2)
Radiator patch 806H: inwardly-bent ECS (906I1, 906I2)
Notes: Ground planes larger than radiator patches.

Figure 9K:
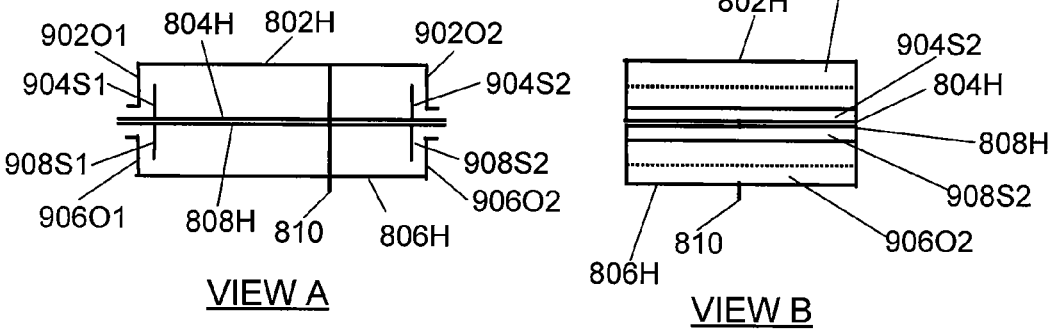

FIG. 9K:
Radiator patch 802H: outwardly-bent ECS (902O1, 902O2)
Ground plane 804H: straight ECS (904S1, 904S2)

Figure 9L:
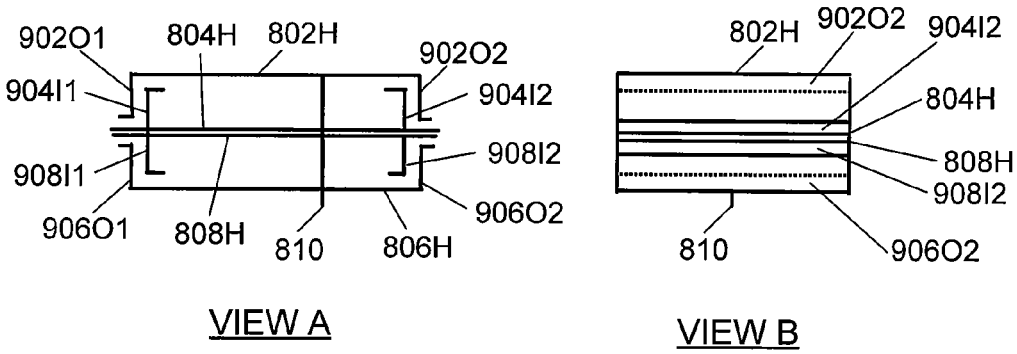

Ground plane 808H: straight ECS (908S1, 908S2)
Radiator patch 806H: outwardly-bent ECS (906O1, 906O2)
None: Capacitive elements on radiator patches on the outside of the capacitive elements on the ground planes.
FIG. 9L:
Radiator patch 802H: outwardly-bent ECS (902O1, 902O2)
Ground plane 804H: inwardly-bent ECS (904I1, 904I2)
Ground plane 808H: inwardly-bent ECS (908I1, 908I2)
Radiator patch 806H: outwardly-bent ECS (906O1, 906O2)
None: Capacitive elements on radiator patches on the outside of the capacitive elements on the ground planes.

FIG. 10A shows a capacitive element configured as a series of linear structures (SLS). These capacitive elements provide additional design parameters for tuning the RF response of the antenna system. Capacitive element SLS 1002V2 includes multiple segments, 1002V2-A, 1002V2-B, 1002V2-C, 1002V2-D, and 1002V2-E. The dimension of each segment is $d_{12}$ along the y-axis; and the spacing between neighboring segments is $d_{13}$ along the y-axis. As shown in FIG. 10B-FIG. 10C, the profile of a SLS can be straight (SLS 1002S1, SLS 1002S1), inwardly-bent (SLS 1002I1, SLS 1002I2), or outwardly-bent (SLS 1002O1, SLS 1002O2), respectively. The cross section of each segment can be square, rectangular, circular, elliptical, or other user-defined shape. The dimensions indicated in the figures are all user-specified design parameters. In an embodiment, $d_{13}>0.1d_{12}$. In general, the angle between a capacitive element and a radiator patch or ground plane can vary from 90 degrees. In general, the bend angles for inwardly-bent and outwardly-bent capacitive elements can vary from 90 degrees.

The dimensions and number of localized structures determine their total equivalent capacitance. To minimize the resonant antenna size, the overlapping area between capacitive elements on the radiator patch and the corresponding capacitive elements on the ground plane should be maximized. Since the capacitive elements on the radiator patch and the corresponding capacitive elements on the ground plane are physically separated, the overlapping area is determined by the area of the capacitive elements on the radiator patch and the area of the corresponding capacitive elements on the ground plane that are facing each other (that is, if the surfaces of the capacitive elements on the radiator patch are orthogonally projected onto the surfaces of the corresponding capacitive elements of the ground plane, the overlapping area is the area in which the projected surfaces of the capacitive elements of the radiator patch overlap with the surfaces of the capacitive elements on the ground plane). Therefore, capacitive elements configured as extended continuous structures will produce the smallest resonance size.

FIG. 10E-FIG. 10O show orthogonal views of various configurations of SLS capacitive elements.

Figure 10E:
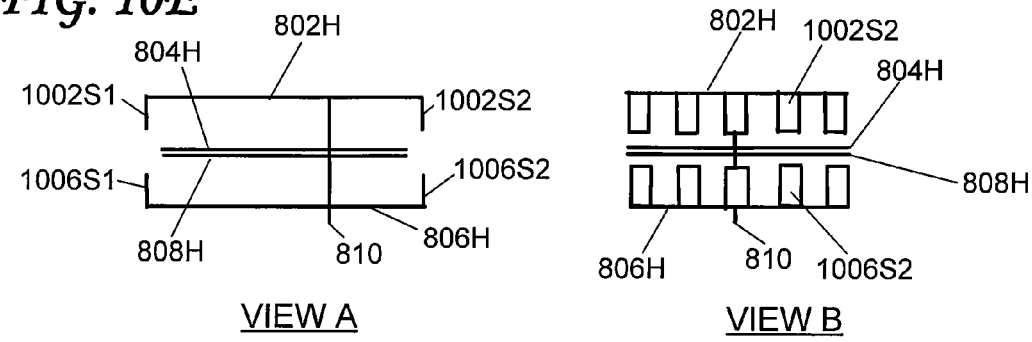
FIG. 10E-FIG. 10O show orthogonal views of different embodiments of series of localized structures configured on radiator patches and ground planes for a single-band, linearly-polarized antenna system.
Figure 10F:
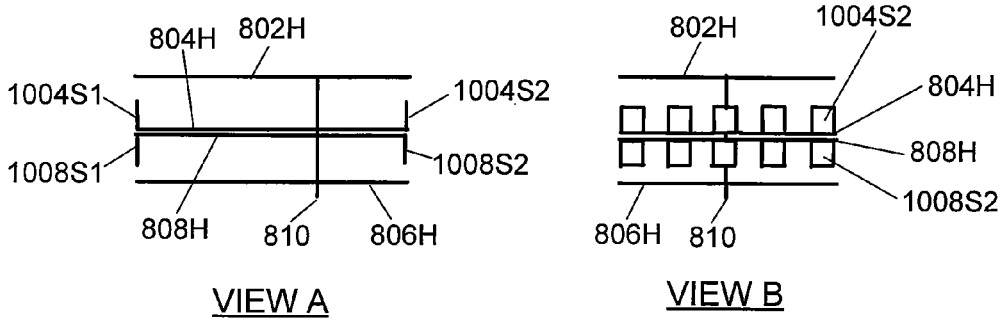
Figure 10G:
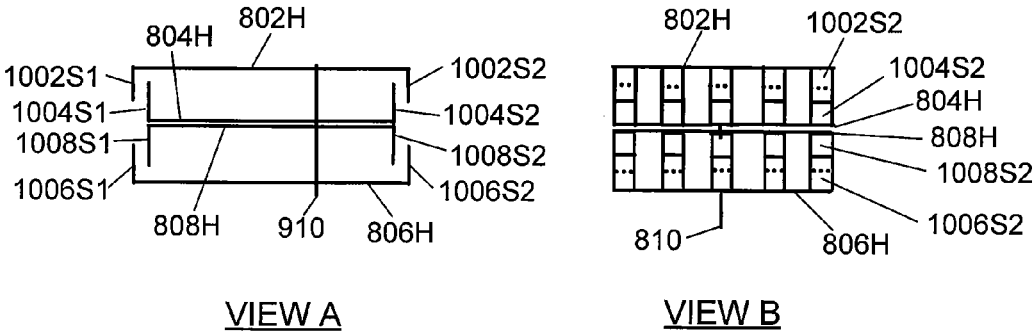
Figure 10H:
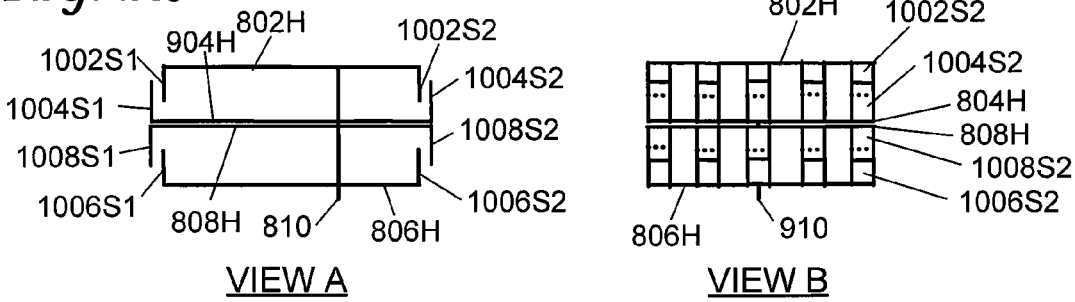
Figure 10I:
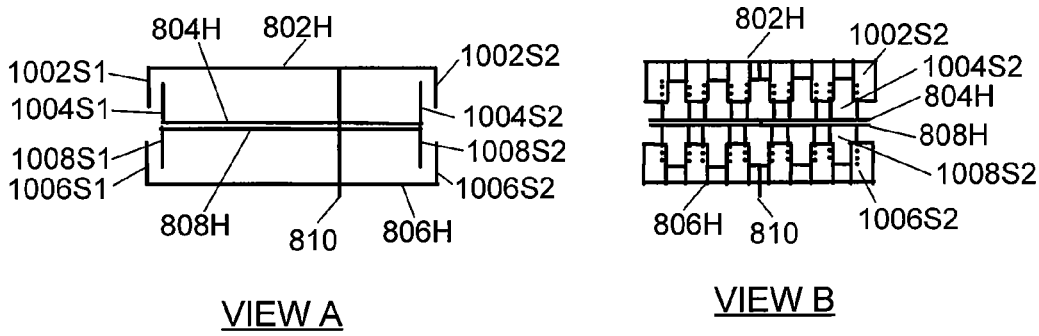
Figure 10J:
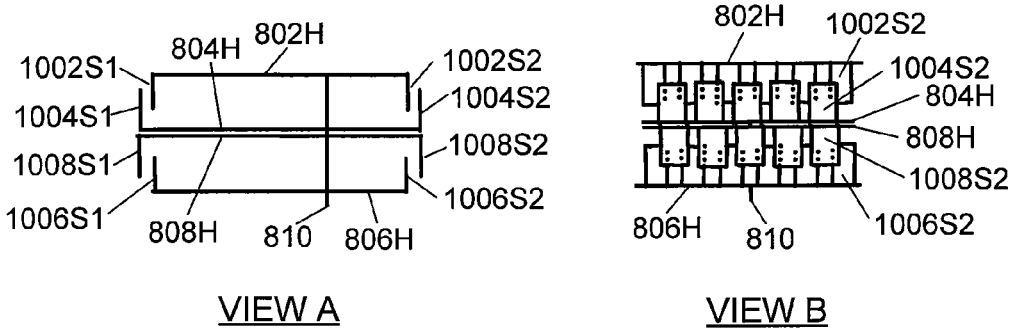
Figure 10K:
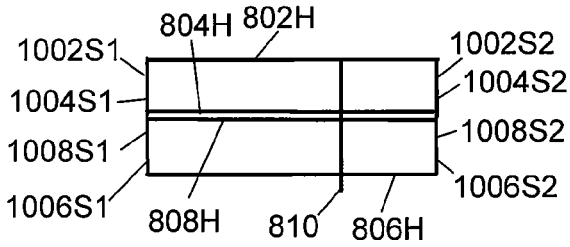
Figure 10K:
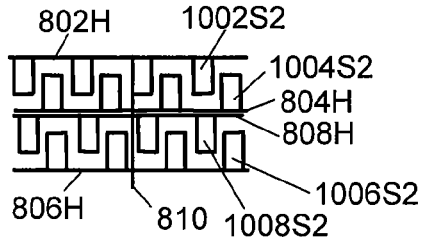
Figure 10L:
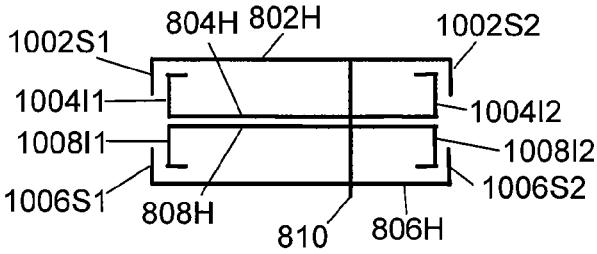
Figure 10L:
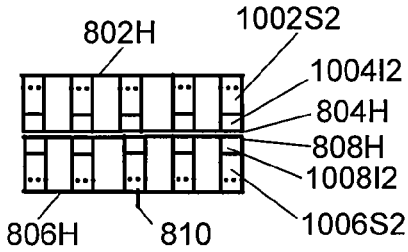
Figure 10M:
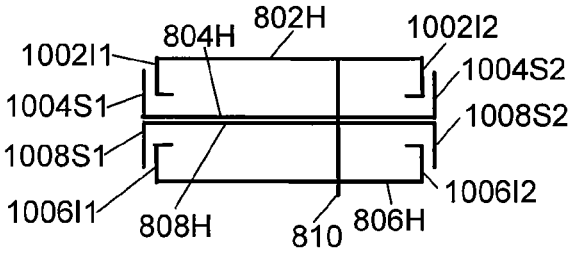
Figure 10M:
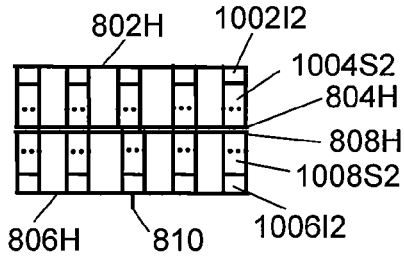
Figure 10N:
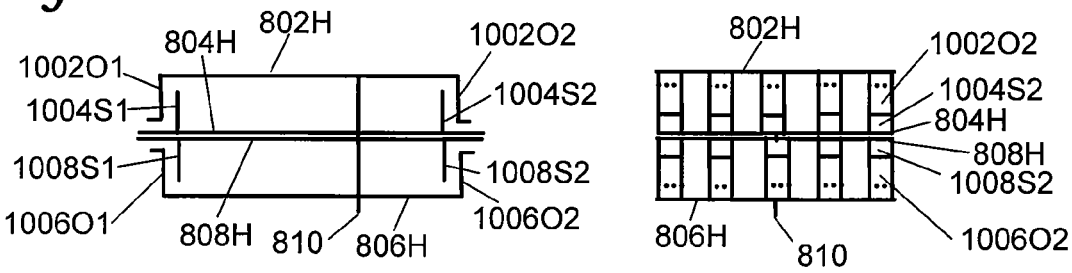
Figure 10O:
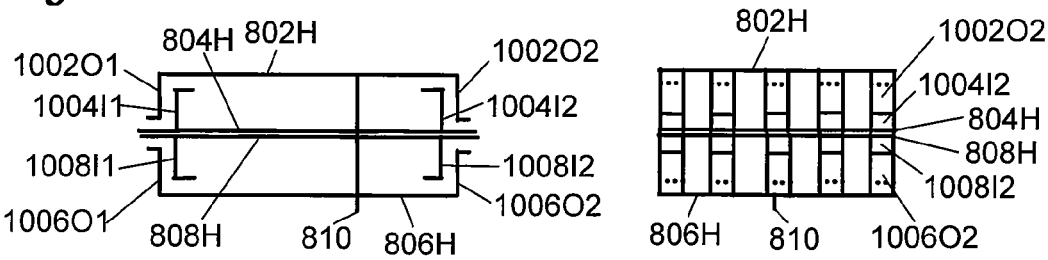

FIG. 10E:
Radiator patch 802H: straight SLS (1002S1, 1002S2)
Ground plane 804H: none
Ground plane 808H: none
Radiator patch 806H: straight SLS (1006S1, 1006S2)
Notes: none.
FIG. 10F:
Radiator patch 802H: none
Ground plane 804H: straight SLS (1004S1, 1004S2)
Ground plane 808H: straight SLS (1008S1, 1008S2)
Radiator patch 806H: none
Notes: none.
FIG. 10G:
Radiator patch 802H: straight SLS (1002S1, 1002S2)
Ground plane 804H: straight SLS (1004S1, 1004S2)
Ground plane 808H: straight SLS (1008S1, 1008S2)
Radiator patch 806H: straight SLS (1006S1, 1006S2)
Notes: Capacitive elements on radiator patches on the outside of the capacitive elements on the ground planes.
FIG. 10H:
Radiator patch 802H: straight SLS (1002S1, 1002S2)
Ground plane 804H: straight SLS (1004S1, 1004S2)
Ground plane 808H: straight SLS (1008S1, 1008S2)
Radiator patch 806H: straight SLS (1006S1, 1006S2)
Notes: Capacitive elements on ground planes on the outside of the capacitive elements on the radiator patches.
FIG. 10I:
Radiator patch 802H: straight SLS (1002S1, 1002S2)
Ground plane 804H: straight SLS (1004S1, 1004S2)
Ground plane 808H: straight SLS (1008S1, 1008S2)
Radiator patch 806H: straight SLS (1006S1, 1006S2)
Notes: Capacitive elements on the radiator patches on the outside of the capacitive elements on the ground planes. Capacitive elements on the radiator patches offset from the capacitive elements on the ground planes.
FIG. 10J:
Radiator patch 802H: straight SLS (1002S1, 1002S2)
Ground plane 804H: straight SLS (1004S1, 1004S2)
Ground plane 808H: straight SLS (1008S1, 1008S2)
Radiator patch 806H: straight SLS (1006S1, 1006S2)
Notes: Capacitive elements on the ground planes on the outside of the capacitive elements on the radiator patches. Capacitive elements on the ground planes wider than the capacitive elements on the radiator patches. Capacitive elements on the radiator patches offset from the capacitive elements on the ground planes.
FIG. 10K:
Radiator patch 802H: straight SLS (1002S1, 1002S2)
Ground plane 804H: straight SLS (1004S1, 1004S2)
Ground plane 808H: straight SLS (1008S1, 1008S2)
Radiator patch 806H: straight SLS (1006S1, 1006S2)
Notes: Capacitive elements on the ground planes interdigitated with the capacitive elements on the radiator patches.
FIG. 10L:
Radiator patch 802H: straight SLS (1002S1, 1002S2)
Ground plane 804H: inwardly-bent SLS (1004I1, 1004I2)
Ground plane 808H: inwardly-bent SLS (1008I1, 1008I2)
Radiator patch 806H: straight SLS (1006S1, 1006S2)
Notes: Capacitive elements on the radiator patches on the outside of the capacitive elements on the ground planes.
FIG. 10M:
Radiator patch 802H: inwardly-bent SLS (1002I1, 1002I2)
Ground plane 804H: straight SLS (1004S1, 1004S2)
Ground plane 808H: straight SLS (1008S1, 1008S2)
Radiator patch 806H: inwardly-bent SLS (1006I1, 1006I2)
Notes: Capacitive elements on the ground planes on the outside of the capacitive elements on the radiator patches.
FIG. 10N:
Radiator patch 802H: outwardly-bent SLS (1002O1, 1002O2)
Ground plane 804H: straight SLS (1004S1, 1004S2)
Ground plane 808H: straight SLS (1008S1, 1008S2)
Radiator patch 806H: outwardly-bent SLS (1006O1, 1006O2)
Notes: Capacitive elements on the radiator patches on the outside of the capacitive elements on the ground planes.

FIG. 10O:

Radiator patch 802H: outwardly-bent SLS (1002O1, 1002O2)

Ground plane 804H: inwardly-bent SLS (1004I1, 1004I2)

Ground plane 808H: inwardly-bent SLS (1008I1, 1008I2)

Radiator patch 806H: outwardly-bent SLS (1006O1, 1006O2)

Notes: Capacitive elements on the radiator patches on the outside of the capacitive elements on the ground planes.

Figure 11A:
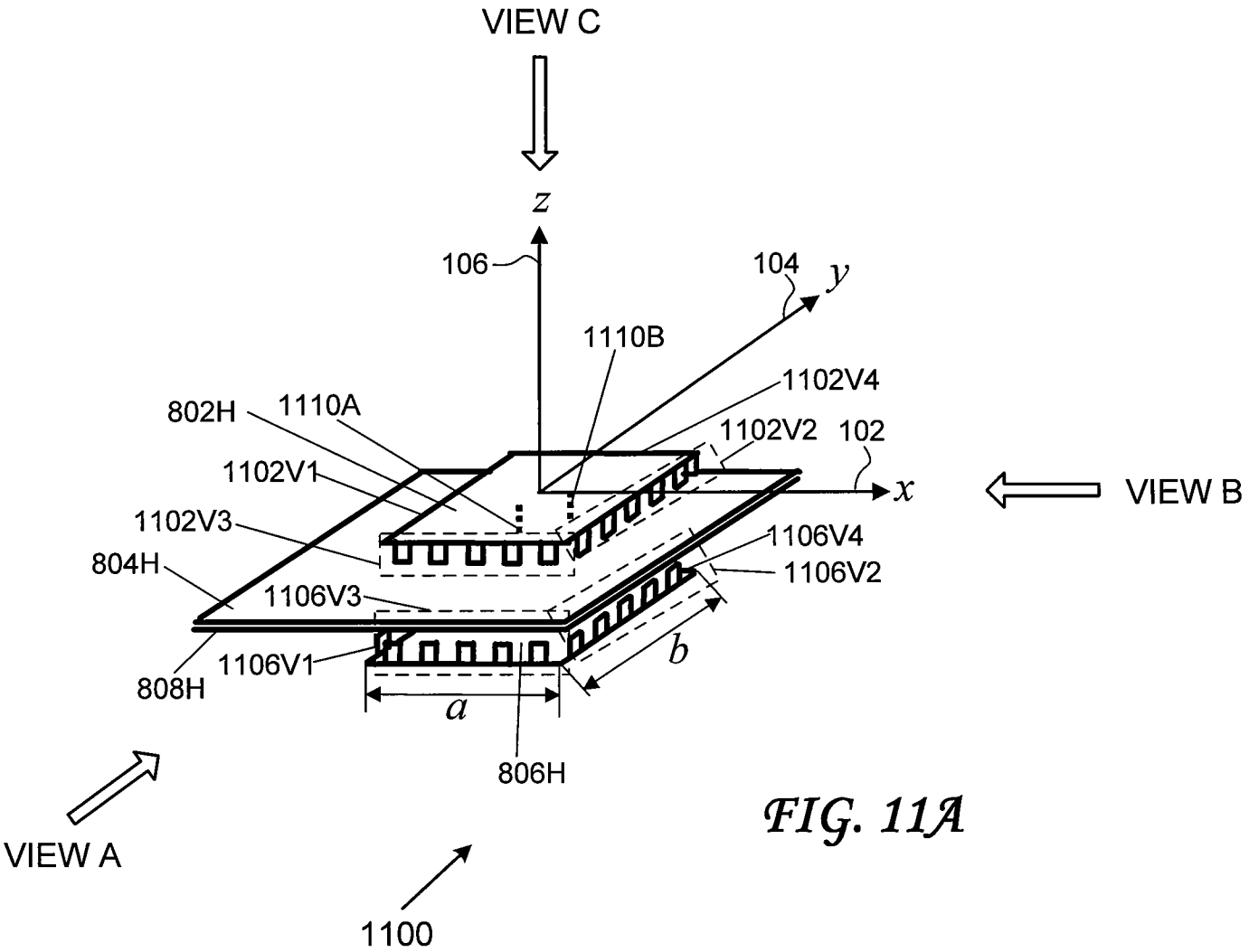
FIG. 11A shows a perspective view of a single-band, circularly-polarized antenna system.
Figure 11B:
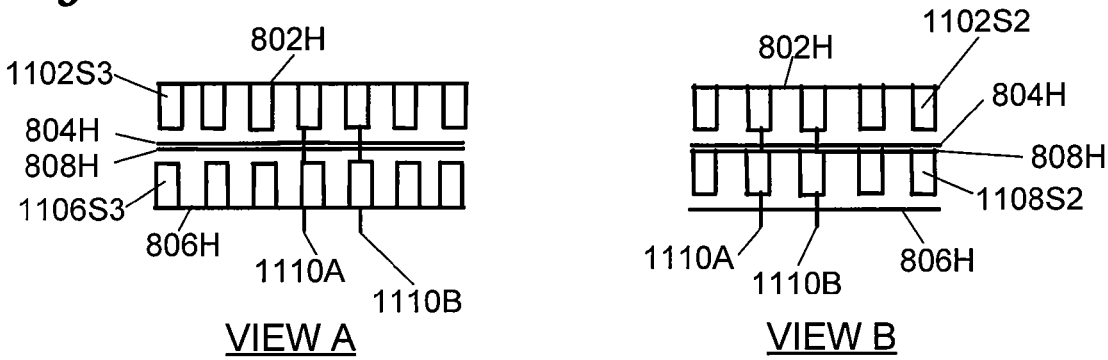
Figure 11C:
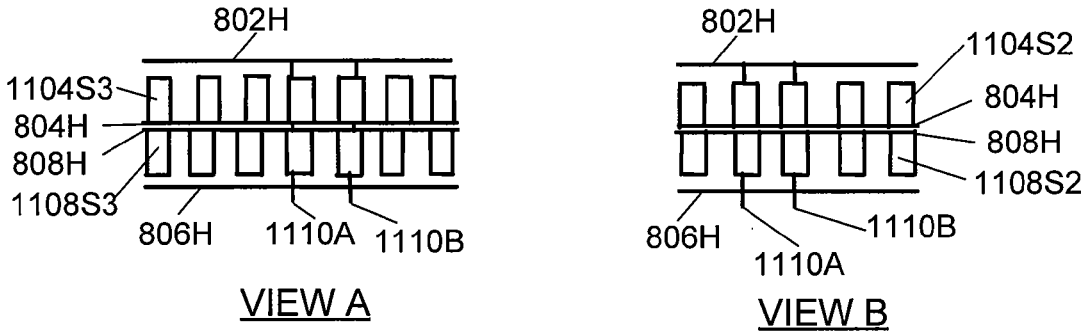
Figure 11D:
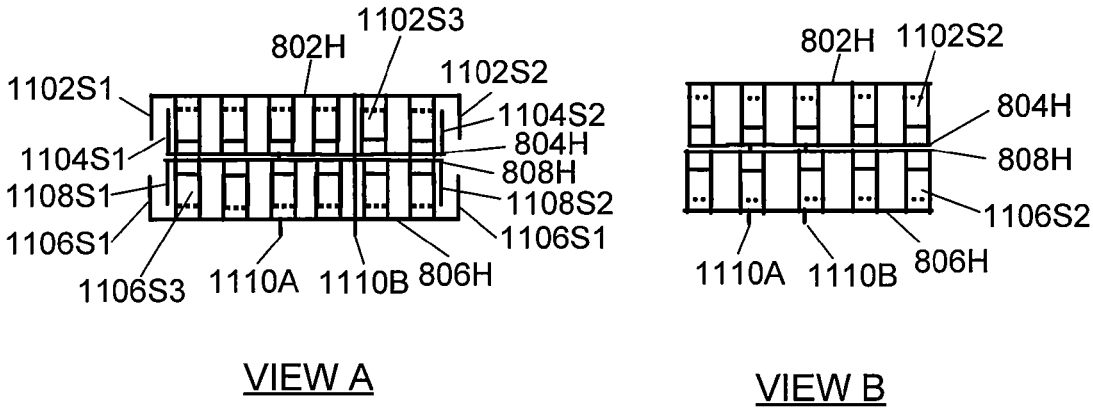
Figure 11E:
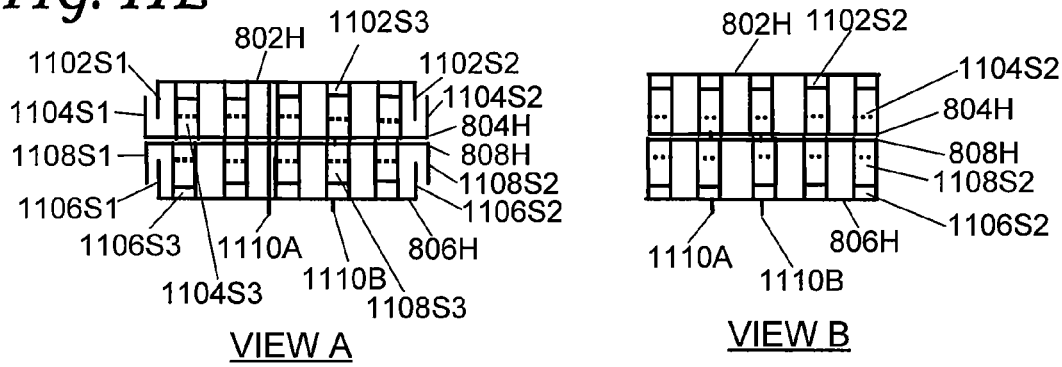
Figure 11F:
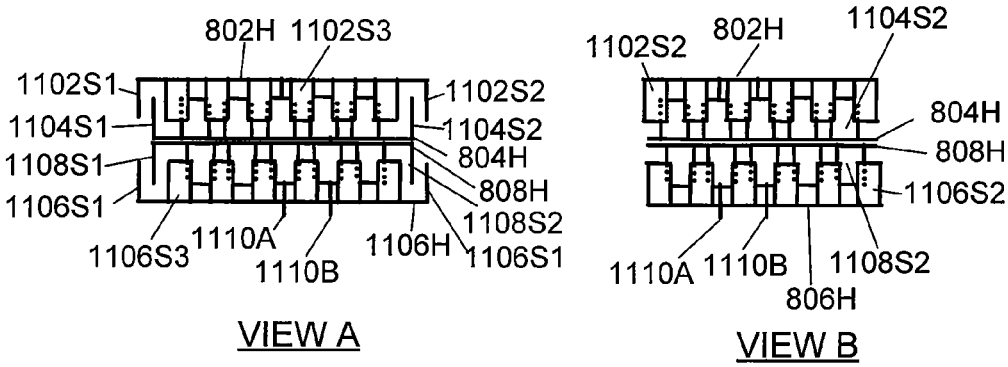
Figure 11G:
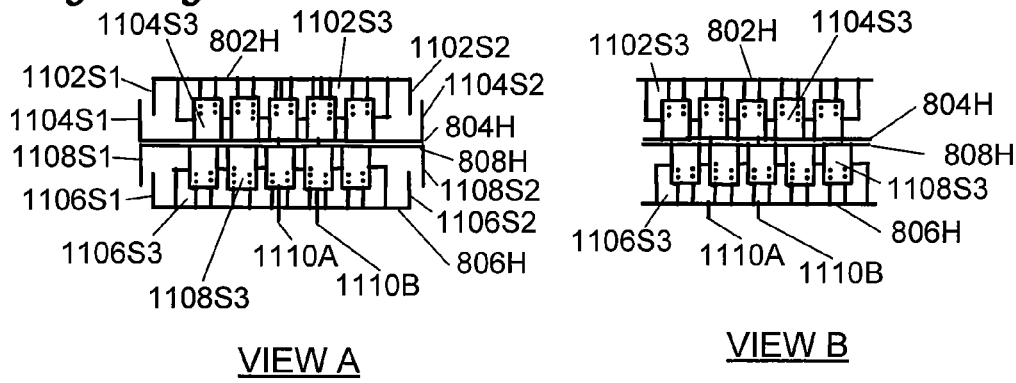
Figure 11H:
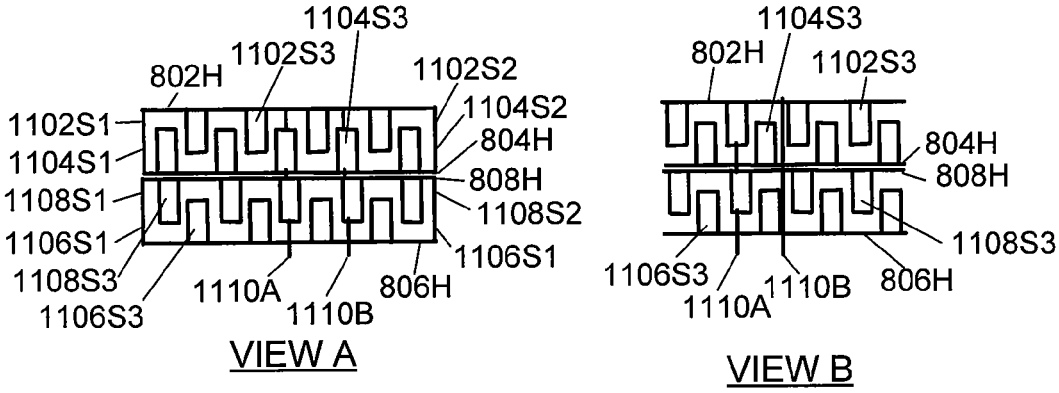
Figure 1I:
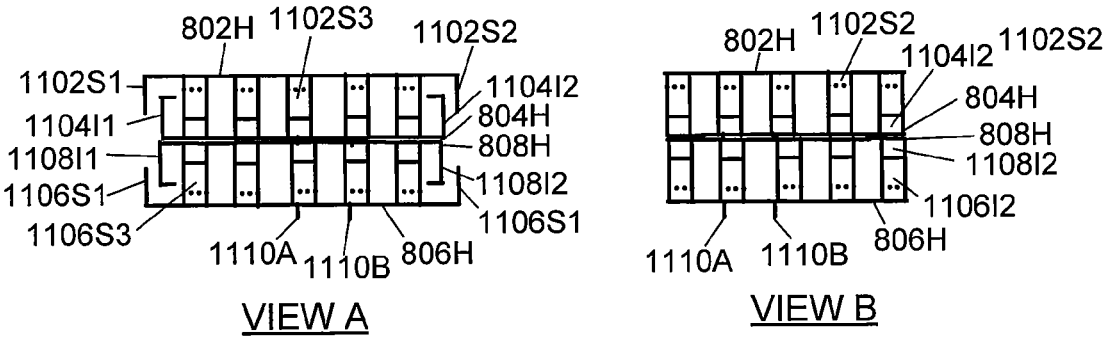
Figure 11J:
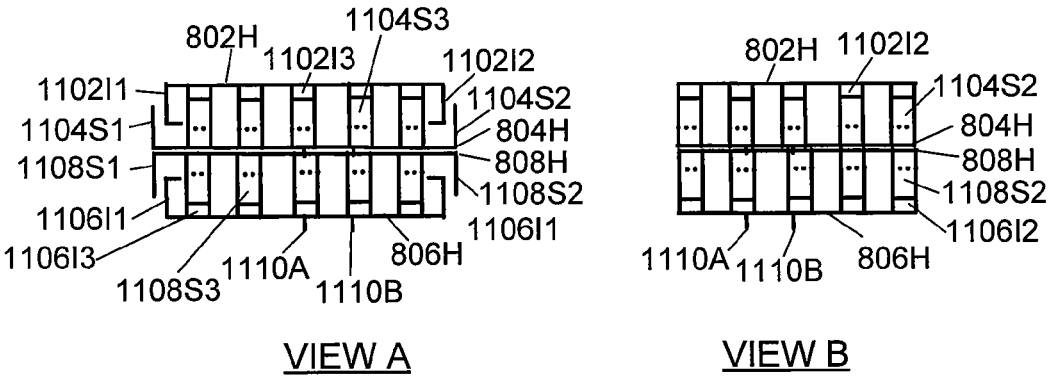
Figure 11K:
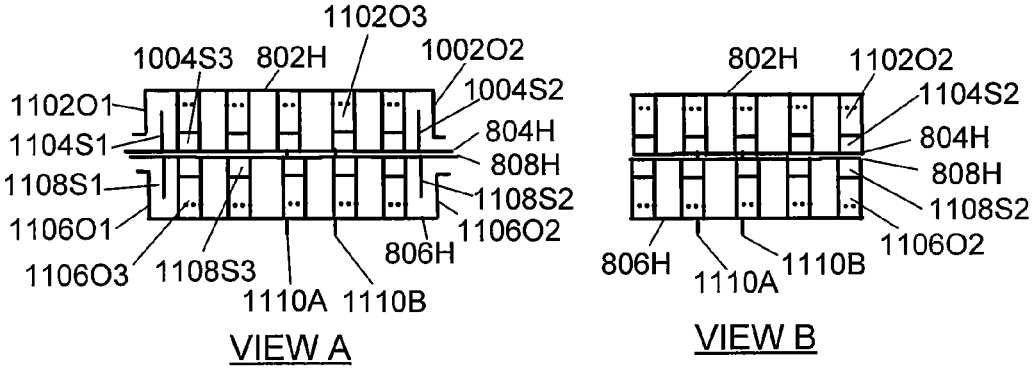
Figure 11L:
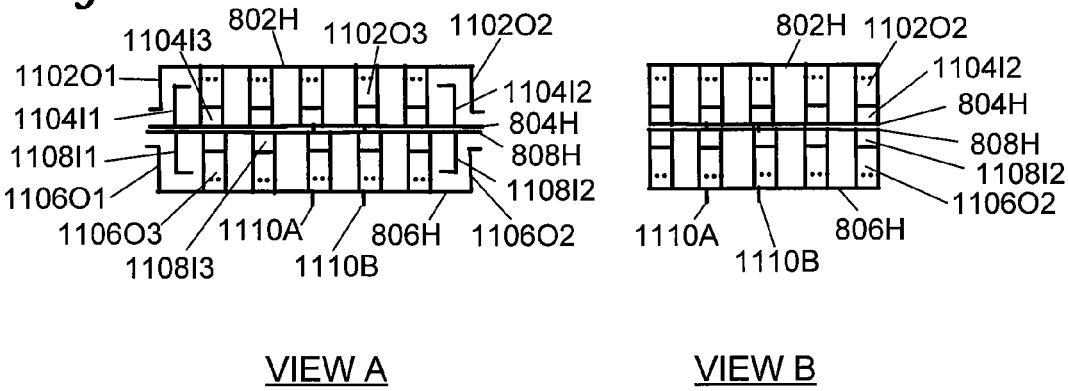

FIG. 11A shows a perspective view of a an embodiment of a single-band antenna system, referenced as antenna system 1100, for circularly-polarized radiation. The antenna system includes a top antenna assembly (radiator patch 802H and corresponding ground plane 804H) and a bottom antenna assembly (radiator patch 806H and corresponding ground plane 808H). In the embodiment shown in FIG. 11A, the radiator patches and ground planes have rectangular geometries. Other geometries, such as circular geometries, can be used in other embodiments. Each radiator patch is separated from its corresponding ground plane by an air gap. In other embodiments, each radiator patch is separated from its corresponding ground plane by a solid dielectric substrate.

The capacitive elements are configured as SLSs along all four edges of a radiator patch. Capacitive elements SLS 1102V1 and SLS 1102V2 are configured along the y-axis of radiator patch 802H. Capacitive elements SLS 1102V3 and SLS 1102V4 are configured along the x-axis of radiator patch 802H. Capacitive elements SLS 1106V1 and SLS 1106V2 are configured along the y-axis of radiator patch 806H. Capacitive elements SLS 1106V3 and SLS 1106V4 are configured along the x-axis of radiator patch 806H.

In the embodiment shown in FIG. 11A, the radiator patch 802H and the radiator patch 806H are both rectangular, with length b along the y-axis and width a along the x-axis. Note that the rectangular geometry includes the case of a square geometry (a=b) that is often used in embodiments of patch antennas for circularly-polarized radiation. The ground plane 804H can be larger than the radiator patch 802H, and the ground plane 808H can be larger than the radiator patch 806H.

The radiator patch 802H in the top antenna assembly is excited by exciter rods; the radiator patch 806H in the bottom antenna assembly is not excited. The field of circular polarization is a sum of two linear polarizations, orthogonal to each other and shifted in phase by 90 degrees. To excite this field, two rods are used, rod 1110A and rod 1110B. The location of rod 1110B is shifted from the geometrical center of radiator patch 802H along the x-axis. The location of rod 1110A is shifted from the geometrical center of radiating element 802H along the y-axis. The x-z plane is the E-plane for the field excited by rod 1110B and the H-plane for the field excited by rod 1110A. For the field excited by rod 1110B, SLS 1102V1 and SLS 1102V2 are aligned along the magnetic field vector (in the H-plane). SLS 1102V3 and SLS 1102V4 are aligned along the electric field vector (in the E-plane). Similarly, for the field excited by rod 1110A, SLS 1102V1 and SLS 1102V2 are aligned along the electric field vector (in the E-plane). SLS 1102V3 and SLS 1102V4 are aligned along the magnetic field vector (in the H-plane).

FIG. 11B-FIG. 11L show orthogonal views of other embodiments of circularly-polarized antenna systems. In general, SLS capacitive elements can be configured along the perimeter of the radiator patch, along the perimeter of the ground plane, or along the perimeter of the radiator patch and the perimeter of the ground plane.

FIG. 11B:

Radiator patch 802H, along x-axis: straight SLS (1102S3, 1102S4)

Radiator patch 802H, along y-axis: straight SLS (1102S1, 1102S2)

Ground plane 804H, along x-axis: none

Ground plane 804H, along y-axis: none

Ground plane 808H, along x-axis: none

Ground plane 808H, along y-axis: straight SLS (1108S1, 1108S2)

Radiator patch 806H, along x-axis: straight SLS (1106S3, 1106S4)

Radiator patch 806H, along y-axis: none

Notes: none.

FIG. 11C:

Radiator patch 802H, along x-axis: none

Radiator patch 802H, along y-axis: none

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: none

Radiator patch 806H, along y-axis: none

Notes: none.

FIG. 11D:

Radiator patch 802H, along x-axis: straight SLS (1102S3, 1102S4)

Radiator patch 802H, along y-axis: straight SLS (1102S1, 1102S4)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: straight SLS (1106S3, 1106S4)

Radiator patch 806H, along y-axis: straight SLS (1106S1, 1106S2)

Notes: Capacitive elements on the radiator patches on the outside of the capacitive elements on the ground planes.

FIG. 11E:

Radiator patch 802H, along x-axis: straight SLS (1102S3, 1102S4)

Radiator patch 802H, along y-axis: straight SLS (1102S1, 1102S2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: straight SLS (1106S3, 1106S4)

Radiator patch 806H, along y-axis: straight SLS (1106S1, 1106S2)

Notes: Capacitive elements on the ground planes on the outside of the capacitive elements on the radiator patches.

FIG. 11F:

Radiator patch 802H, along x-axis: straight SLS (1102S3, 1102S4)

Radiator patch 802H, along y-axis: straight SLS (1102S1, 1102S2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: straight SLS (1106S3, 1106S4)

Radiator patch 806H, along y-axis: straight SLS (1106S1, 1106S2)

Notes: Capacitive elements on the radiator patches on the outside of the capacitive elements on the ground planes. Capacitive elements on the radiator patches offset with respect to the capacitive elements on the ground planes.

FIG. 11G:

Radiator patch 802H, along x-axis: straight SLS (1102S3, 1102S4)

Radiator patch 802H, along y-axis: straight SLS (1104S1, 1104S2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: straight SLS (1106S3, 1106S4)

Radiator patch 806H, along y-axis: straight SLS (1106S1, 1106S2)

Notes: Capacitive elements on the ground planes on the outside of the capacitive elements on the radiator patches. Capacitive elements on the radiator patches offset with respect to the capacitive elements on the ground planes.

FIG. 11H:

Radiator patch 802H, along x-axis: straight SLS (1102S3, 1102S4)

Radiator patch 802H, along y-axis: straight SLS (1104S1, 1104S2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: straight SLS (1106S3, 1106S4)

Radiator patch 806H, along y-axis: straight SLS (1106S1, 1106S2)

Notes: Capacitive elements on the radiator patches interdigitated with the capacitive elements on the ground planes.

FIG. 11I:

Radiator patch 802H, along x-axis: straight SLS (1102S3, 1102S4)

Radiator patch 802H, along y-axis: straight SLS (1104S1, 1104S2)

Ground plane 804H, along x-axis: inwardly-bent SLS (1104I3, 1104I4)

Ground plane 804H, along y-axis: inwardly-bent SLS (1104I1, 1104I2)

Ground plane 808H, along x-axis: inwardly-bent SLS (1108I3, 1108I4)

Ground plane 808H, along y-axis: inwardly-bent SLS (1108I1, 1108I2)

Radiator patch 806H, along x-axis: straight SLS (1106S3, 1106S4)

Radiator patch 806H, along y-axis: straight SLS (1106S1, 1106S2)

Notes: Capacitive elements on the ground planes on the outside of the capacitive elements on the radiator patches.

FIG. 11J:

Radiator patch 802H, along x-axis: inwardly-bent SLS (1102I3, 1102I4)

Radiator patch 802H, along y-axis: inwardly-bent SLS (1104I1, 1104I2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: inwardly-bent SLS (1106I3, 1106I4)

Radiator patch 806H, along y-axis: inwardly-bent (1106I1, 1106I2)

Notes: Capacitive elements on the ground planes on the outside of the capacitive elements on the radiator patches.

FIG. 11K:

Radiator patch 802H, along x-axis: outwardly-bent SLS (1102O3, 1102O4)

Radiator patch 802H, along y-axis: outwardly-bent SLS (1104O1, 1104O2)

Ground plane 804H, along x-axis: straight SLS (1104S3, 1104S4)

Ground plane 804H, along y-axis: straight SLS (1104S1, 1104S2)

Ground plane 808H, along x-axis: straight SLS (1108S3, 1108S4)

Ground plane 808H, along y-axis: straight SLS (1108S1, 1108S2)

Radiator patch 806H, along x-axis: outwardly-bent SLS (1106O3, 1106O4)

Radiator patch 806H, along y-axis: outwardly-bent (1106O1,1106O2)

Notes: Capacitive elements on the radiator patches on the outside of the capacitive elements on the ground planes.

FIG. 11L:

Radiator patch 802H, along x-axis: outwardly-bent SLS (1102O3, 1102O4)

Radiator patch 802H, along y-axis: outwardly-bent SLS (1104O1, 1104O2)

Ground plane 804H, along x-axis: inwardly-bent SLS (1104I3, 1104I4)

Ground plane 804H, along y-axis: inwardly-bent SLS (1104I1, 1104I2)

Ground plane 808H, along x-axis: inwardly-bent SLS (1108I3, 1108I4)

Ground plane 808H, along y-axis: inwardly-bent SLS (1108I1, 1108I2)

Radiator patch 806H, along x-axis: outwardly-bent SLS (1106O3, 1106O4)

Radiator patch 806H, along y-axis: outwardly-bent (1106O1,1106O2)

Notes: Capacitive elements on the radiator patches on the outside of the capacitive elements on the ground planes.

Figure 7:
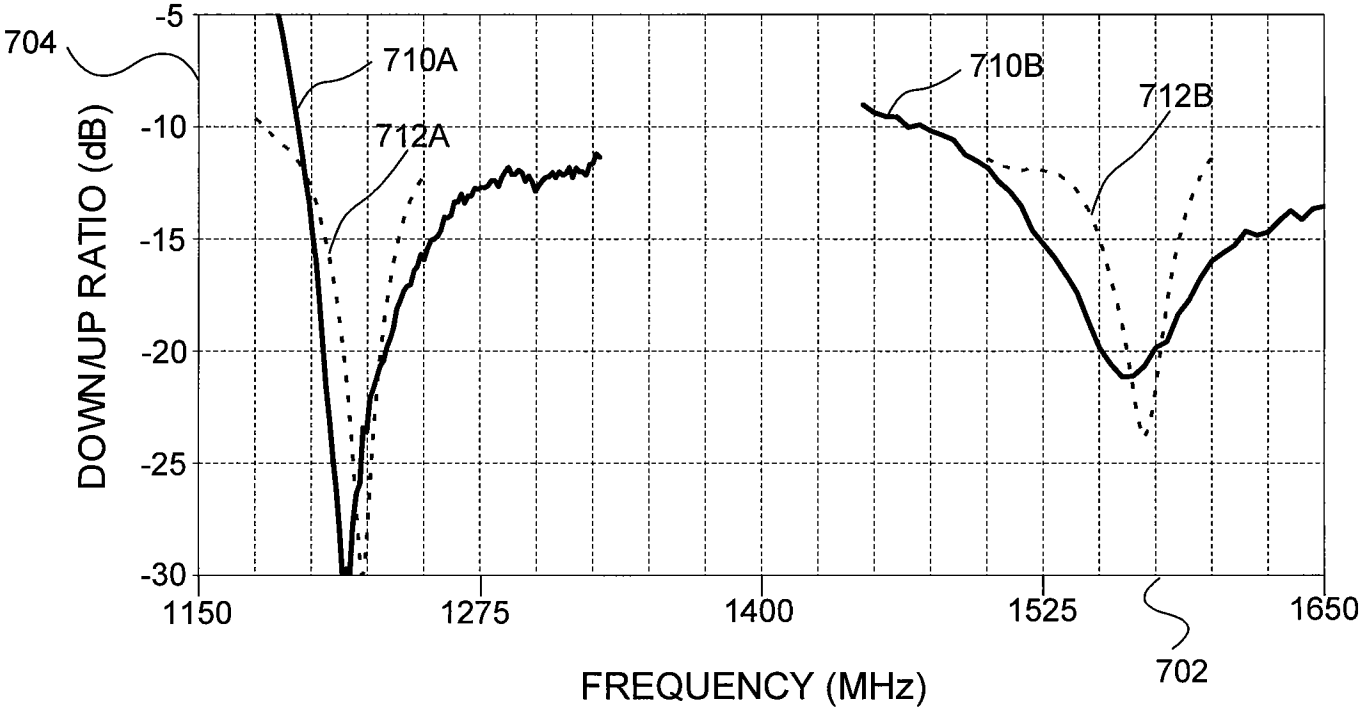
FIG. 7 compares plots of down/up ratios as a function of frequency for an antenna system according to an embodiment of the invention and a prior-art antenna system.

FIG. 7 shows plots of the down/up ratio for two antenna systems within the L1 and L2 frequency bands. The horizontal axis 702 represents the frequency in MHz. The vertical axis represents the down/up ratio in dB. Plot 710A and plot 710B show results in the L1 and L2 frequency bands, respectively, for an antenna system according to an embodiment of the invention. For comparison, plot 712A and plot 712B show results in the L1 and L2 frequency bands, respectively, for a prior-art antenna system.

In practice, the frequency range over which the down/up ratio is less than a specified maximum value (for example, −15 dB or −20 dB) is used to characterize the multipath resistance of the antenna system. Comparison of plot 710A and plot 712A in the L1 band and comparison of plot 710B and plot 712B in the L2 band show that, for a maximum down/up ratio of −15 dB to −20 dB, the frequency range for an antenna according to an embodiment of the invention is 20-30% greater than the frequency range for the prior-art antenna.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A patch antenna system comprising:

a first antenna assembly comprising:

a first ground plane having a first perimeter, a first surface, and a second surface, wherein the second surface is opposite the first surface;

a first radiator patch having a second perimeter, wherein the first radiator patch is spaced apart from the first surface;

a first dielectric medium disposed between the first radiator patch and the first surface; and an exciter configured to excite first electromagnetic signals in the first radiator patch;

a second antenna assembly electromagnetically coupled to the first antenna assembly, the second antenna assembly comprising:

a second ground plane having a third perimeter, a third surface, and a fourth surface, wherein:

the fourth surface is opposite the third surface;

the third surface is adjacent to the second surface;

the first ground plane is disposed between the second ground plane and the first dielectric medium; and the second ground plane is electrically connected to the first ground plane;

a second radiator patch having a third fourth perimeter, wherein:

the second radiator patch is spaced apart from the fourth surface;

the second ground plane is disposed between the first ground plane and the second radiator patch; and the second radiator patch is configured to excite second electromagnetic signals in response to third electromagnetic signals induced by the first electromagnetic signals;

a second dielectric medium disposed between the second radiator patch and the fourth surface; and a signal port electrically connected to the first radiator patch and electromagnetically coupled to the second radiator patch.

2. The patch antenna system of claim 1, wherein the first electromagnetic signals and the second electromagnetic signals have opposite phases.

3. The patch antenna system of claim 1, wherein:

the first antenna assembly has a first resonant frequency; and the second antenna assembly has a second resonant frequency approximately equal to the first resonant frequency.

4. The patch antenna system of claim 3, wherein:

the first resonant frequency is the central operational frequency of a global navigation satellite system operational frequency band; and the second resonant frequency is within +/−5% of the first resonant frequency.

5. The patch antenna system of claim 1, wherein:

the first dielectric medium comprises a first solid dielectric substrate having a first permittivity; and the second dielectric medium comprises a second solid dielectric substrate having a second permittivity.

6. The patch antenna system of claim 1, wherein the first dielectric medium and the second dielectric medium comprise air, further comprising:

a first set of capacitive elements along at least one of the first perimeter and the second perimeter; and a second set of capacitive elements along at least one of the third perimeter and the fourth perimeter.

7. The patch antenna system of claim 6, wherein the first set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

8. The patch antenna system of claim 6, wherein the second set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

9. The patch antenna system of claim 1, wherein the patch antenna system is configured to operate in a linear polarization mode.

10. The patch antenna system of claim 1, wherein the patch antenna system is configured to operate in a circular polarization mode.

11. The patch antenna system of claim 1, further comprising a low-noise amplifier disposed within the patch antenna system.

12. The patch antenna system of claim 1, further comprising a navigation receiver having an electrically conductive case electrically connected to the second radiator patch.

13. The patch antenna system of claim 1, further comprising an electrically conductive closed cavity electrically connected to the second radiator patch.

14. The patch antenna system of claim 13, further comprising a navigation receiver disposed within the electrically conductive closed cavity.

15. The patch antenna system of claim 13, wherein the electrically conductive closed cavity is a first electrically conductive closed cavity, further comprising:

a second electrically conductive closed cavity electrically connected to the first electrically conductive closed cavity.

16. The patch antenna system of claim 15, further comprising an auxiliary unit disposed within the second electrically conductive closed cavity.

17. The patch antenna system of claim 16, wherein the auxiliary unit comprises one of:

a low-noise amplifier;

a signal processor;

an attitude sensor; or a tilt sensor.

18. A patch antenna system comprising:

a first antenna assembly comprising:

a first ground plane having a first perimeter, a first surface, and a second surface, wherein the second surface is opposite the first surface;

a first radiator patch having a second perimeter, wherein the first radiator patch is spaced apart from the first surface;

a first dielectric medium disposed between the first radiator patch and the first surface; and a first exciter configured to excite first electromagnetic signals having a first frequency in the first radiator patch;

a second antenna assembly electromagnetically coupled to the first antenna assembly, the second antenna assembly comprising:

a second ground plane having a third perimeter, a third surface, and a fourth surface, wherein:

the fourth surface is opposite the third surface;

the third surface is adjacent to the second surface;

the first ground plane is disposed between the second ground plane and the first dielectric medium; and the second ground plane is electrically connected to the first ground plane;

a second radiator patch having a fourth perimeter, wherein:

the second radiator patch is spaced apart from the fourth surface;

the second ground plane is disposed between the first ground plane and the second radiator patch; and the second radiator patch is configured to excite second electromagnetic signals in response to third electromagnetic signals induced by the first electromagnetic signals;

a second dielectric medium disposed between the second radiator patch and the fourth surface;

a first signal port electrically connected to the first radiator patch and electromagnetically coupled to the second radiator patch;

a third antenna assembly comprising:

a third ground plane having a fifth perimeter, a fifth surface, and a sixth surface, wherein:

the sixth surface is opposite the fifth surface;

the fifth surface is adjacent to the first radiator patch;

the first radiator patch is disposed between the fifth surface and the first dielectric medium; and the third ground plane is electrically connected to the first radiator patch;

a third radiator patch having a sixth perimeter, wherein:

the third radiator patch is spaced apart from the sixth surface, and the third ground plane is disposed between the third radiator patch and the first radiator patch;

a third dielectric medium disposed between the third radiator patch and the sixth surface; and a second exciter configured to excite fourth electromagnetic signals having a second frequency in the third radiator patch;

a fourth antenna assembly electromagnetically coupled to the third antenna assembly, the fourth antenna assembly comprising:

a fourth ground plane having a seventh perimeter, a seventh surface, and an eighth surface, wherein:

the eighth surface is opposite the seventh surface, the seventh surface is adjacent to the second radiator patch, the second radiator patch is disposed between the second dielectric medium and the seventh surface; and the fourth ground plane is electrically connected to the second radiator patch;

a fourth radiator patch having an eighth perimeter, wherein:

the fourth radiator patch is spaced apart from the eighth surface, the fourth ground plane is disposed between the fourth radiator patch and the second radiator patch; and the fourth radiator patch is configured to excite fifth electromagnetic signals in response to sixth electromagnetic signals induced by the fourth electromagnetic signals;

a fourth dielectric medium disposed between the fourth radiator patch and the eighth surface; and a second signal port electrically connected to the third radiator patch and electromagnetically coupled to the fourth radiator patch.

19. The patch antenna system of claim 18, wherein:

the first electromagnetic signals and the second electromagnetic signals have opposite phases; and the fourth electromagnetic signals and the fifth electromagnetic signals have opposite phases.

20. The patch antenna system of claim 18, wherein:

the first antenna assembly has a first resonant frequency;

the second antenna assembly has a second resonant frequency;

the third antenna assembly has a third resonant frequency; and the fourth antenna assembly has a fourth resonant frequency.

21. The patch antenna system of claim 20, wherein the first resonant frequency is the central operational frequency of a global navigation satellite system first operational frequency band;

the second resonant frequency is within +/−5% of the first resonant frequency;

the third resonant frequency is the central operational frequency of a global navigation satellite system second operational frequency band, wherein the global navigation satellite system second operational frequency band is different from the global navigation satellite system first operational frequency band; and the fourth resonant frequency is within +/−5% of the third resonant frequency.

22. The patch antenna system of claim 18, wherein:

the first dielectric medium comprises a first solid dielectric substrate having a first permittivity;

the second dielectric medium comprises a second solid dielectric substrate having a second permittivity;

the third dielectric medium comprises a third solid dielectric substrate having a third permittivity; and the fourth dielectric medium comprises a fourth solid dielectric substrate having a fourth permittivity.

23. The patch antenna system of claim 18, wherein the first dielectric medium, the second dielectric medium, the third dielectric medium, and the fourth dielectric medium comprise air, further comprising:

a first set of capacitive elements along at least one of the first perimeter and the second perimeter;

a second set of capacitive elements along at least one of the third perimeter and the fourth perimeter;

a third set of capacitive elements along at least one of the fifth perimeter and the sixth perimeter; and a fourth set of capacitive elements along at least one of the seventh perimeter and the eighth perimeter.

24. The patch antenna system of claim 23, wherein the first set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

25. The patch antenna system of claim 23, wherein the second set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

26. The patch antenna system of claim 23, wherein the third set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

27. The patch antenna system of claim 23, wherein the fourth set of capacitive elements comprises one of:

a set of straight extended continuous structures;

a set of inwardly-bent extended continuous structures;

a set of outwardly-bent continuous structures;

a straight series of localized structures;

an inwardly-bent series of localized structures; or an outwardly-bent series of localized structures.

28. The patch antenna system of claim 18, wherein the patch antenna system is configured to operate in a linear polarization mode.

29. The patch antenna system of claim 18, wherein the patch antenna system is configured to operate in a circular polarization mode.

30. The patch antenna system of claim 18, further comprising a low-noise amplifier disposed within the patch antenna system.

31. The patch antenna system of claim 18, further comprising a navigation receiver having an electrically conductive case electrically connected to the second radiator patch.

32. The patch antenna system of claim 18, further comprising an electrically conductive closed cavity electrically connected to the second radiator patch.

33. The patch antenna system of claim 32, further comprising a navigation receiver disposed within the electrically conductive closed cavity.

34. The patch antenna system of claim 32, wherein the electrically conductive closed cavity is a first electrically conductive closed cavity, further comprising:

a second electrically conductive closed cavity electrically connected to the first electrically conductive closed cavity.

35. The patch antenna system of claim 34, further comprising an auxiliary unit disposed within the second electrically conductive closed cavity.

36. The patch antenna system of claim 35, wherein the auxiliary unit comprises one of:

a low-noise amplifier;

a signal processor;

an attitude sensor; or a tilt sensor.

* * * * *